US005715797A

United States Patent [19]

Minagawa et al.

[11] Patent Number: 5,715,797

[45] Date of Patent: Feb. 10, 1998

[54] FUEL SUPPLY SYSTEM FOR INTERNAL COMBUSTION ENGINE AND METHOD OF ADJUSTING IT

[75] Inventors: Kazuji Minagawa, Tokoname; Takeshi Matsuda, Anjo; Kiyotoshi Oi, Toyohashi; Shigeru Takeuchi, Gamagori; Takayoshi Yamaguchi, Hoi-gun, all of Japan

[73] Assignee: Nippondenso Co., Ltd., Kariya, Japan

[21] Appl. No.: 668,382

[22] Filed: Jun. 21, 1996

[30] Foreign Application Priority Data

| | | | |
|---|---|---|---|
| Jun. 28, 1995 | [JP] | Japan | 7-161690 |
| Jul. 31, 1995 | [JP] | Japan | 7-195520 |
| Oct. 31, 1995 | [JP] | Japan | 7-283428 |

[51] Int. Cl.[6] ..... F02M 37/04

[52] U.S. Cl. ..... 123/497; 123/478

[58] Field of Search ..... 123/495, 497, 123/510–511, 458, 478, 514

[56] References Cited

U.S. PATENT DOCUMENTS

| | | | |
|---|---|---|---|
| Re. 33,270 | 7/1990 | Beck et al. | 123/458 |
| 4,359,984 | 11/1982 | Nakao | 123/497 |
| 4,800,859 | 1/1989 | Sagisaka et al. | 123/497 |
| 5,355,859 | 10/1994 | Weber | 123/497 |
| 5,361,742 | 11/1994 | Briggs et al. | 123/514 |
| 5,365,906 | 11/1994 | Deweerdt | 123/510 |
| 5,367,999 | 11/1994 | King et al. | 123/458 |
| 5,377,645 | 1/1995 | Moore | 123/514 |
| 5,379,741 | 1/1995 | Matysiewicz et al. | 123/497 |
| 5,398,655 | 3/1995 | Tuckey | 123/514 |
| 5,406,922 | 4/1995 | Tuckey | 123/497 |
| 5,421,306 | 6/1995 | Talaski | 123/510 |
| 5,448,977 | 9/1995 | Smith et al. | 123/478 |
| 5,477,829 | 12/1995 | Hassinger et al. | 123/510 |
| 5,483,940 | 1/1996 | Namba et al. | 123/497 |

FOREIGN PATENT DOCUMENTS

| | | |
|---|---|---|
| 57-68529 | 4/1982 | Japan . |
| 4-63929 | 2/1992 | Japan . |
| 6-173805 | 6/1994 | Japan . |
| 7-1374 | 1/1995 | Japan . |
| 7-27029 | 1/1995 | Japan . |

*Primary Examiner*—Thomas N. Moulis
*Attorney, Agent, or Firm*—Nixon & Vanderhye P.C.

[57] ABSTRACT

A fuel supply system for an engine having no fuel return pipe is disclosed. In steps target fuel is set according to an engine operating state. Thereafter, a target current value to be supplied to the motor of a fuel pump according to the target fuel pressure is obtained. In the succeeding step, an actual motor current is detected and, then, the target current value and the detcted current are compared. Thereafter, the supply current is controlled by feedback based upon the difference obtained by comparison between the target current value and the detected current value to eliminate the difference.

24 Claims, 25 Drawing Sheets

FUEL SUPPLY FLOW RATE Qf a
c
b
NO FUEL SUPPLY
FUEL PUMP SUPPLY CURRENT I

ROTATING SPEED OF FUEL PUMP Np

FUEL SUPPLY SYSTEM FOR INTERNAL COMBUSTION ENGINE AND METHOD OF ADJUSTING IT

BACKGROUND OF THE INVENTION

1. Field of the Invention

The present invention relates to a fuel supply system for an internal combustion engine and a method of adjusting it. In detail it relates to a fuel-return-pipe-less fuel supply system for an internal combustion engine for supplying fuel to a fuel rail and others by controlling current supplied to a motor for driving a fuel pump and a method of adjusting it.

2. Description of the Related Art

The conventional fuel supply system for injecting fuel into the intake port of an internal combustion engine is constituted so that fuel pumped from a fuel tank by a fuel pump is fed into a fuel rail (a delivery pipe) through a fuel pipe and is injected and supplied from a fuel injection valve corresponding to each cylinder attached to this fuel rail into/to the intake port. A pressure regulator is provided to the fuel rail so that the pressure of fuel supplied to the fuel injection valve is kept at a predetermined pressure and a return pipe for returning excessive fuel to the fuel tank is also provided.

As an example of this type of fuel supply system, a rotating speed control unit of the fuel pump for controlling excessive supply of fuel to reduce a load which is applied to the fuel pump is disclosed in Japanese published unexamined patent application No. Sho 57-68529. This unit precisely controls the rotating speed of the fuel pump by feedback so that current supplied to a motor for driving the fuel pump is the predetermined reference value selected according to the operating condition of the engine.

However, a fuel supply system provided with a return pipe as the system disclosed in the above-described Japanese published unexamined patent application No. Sho 57-68529 has a problem that the system is complicated and the cost of a product is increased because a fuel rail is located in the vicinity of an internal combustion engine.

Accordingly, as a fuel supply system provided with no return pipe for returning excessive fuel in a fuel rail and others to a fuel tank (hereinafter referred to as a returnless fuel supply system for an internal combustion engine), a fuel supply system for an engine disclosed in Japanese published unexamined patent application No. H7-27029 is provided.

This system is provided with a tank in a fuel pump, a pressure control valve for blocking a passage when pressure reaches a predetermined pressure in a fuel supply passage between the fuel pump and a fuel rail and a pressure regulating unit operated with a little higher pressure than the pressure in the body of the fuel pump controlled by the pressure control valve and excessive fuel is directly circulated in the fuel tank by this pressure regulating unit.

However, this system has a problem in that excessive fuel is required for control and the system is complicated.

The system also has a problem in that as excessive fuel is discharged into the fuel pump, the load which is applied to the fuel pump is increased and power consumption is also increased.

Further, the system has a problem in that excessive fuel itself is heated by the fuel pump, the temperature of fuel in the fuel tank rises because heated fuel is circulated in the fuel tank and evaporation cannot be fully prevented.

As another technique, the technique for detecting the fuel pressure in a fuel rail by a fuel pressure sensor to reduce excessive fuel and for controlling voltage applied to a fuel pump to reduce the difference between detected fuel pressure and target fuel pressure is disclosed in U.S. Pat. No. 5,483,940 which corresponds to Japanese published unexamined patent application No. H6-147047.

However, this system has another problem in that applied voltage must be adjusted according to the flow rate of fuel to inject a desired amount of fuel and control is complicated because the system has a characteristic that even if voltage is fixed, fuel pressure varies when the flow rate of fuel is varied.

SUMMARY OF THE INVENTION

The present invention is made to solve the above-described problems and the object is to provide a returnless fuel supply system for an internal combustion engine which requires no excessive fuel and is provided with simple constitution and control and a function advantageous in view of energy such as reduction of power consumption and a method of adjusting it.

According to this invention, current supplied to a dc electric motor for driving a fuel pump is kept a fixed predetermined value by a current control unit, fuel is fed into a delivery pipe under predetermined pressure by this fuel pump, fuel is supplied from the delivery pipe to a fuel injection valve and fuel is injected from the fuel injection valve by a predetermined amount. A current value which flows in the dc electric motor is detected by the current control unit, it is compared with a preset target current value and supplied current is controlled by feedback. As a result, fuel pressure can be maintained at the target fuel pressure.

That is, if the fuel pressure in a delivery valve is detected and voltage applied to the driving motor of the fuel pump is controlled so that the difference between this detected fuel pressure and target fuel pressure is reduced as in the conventional system, voltage for controlling the driving motor must be adjusted according to a fuel supply flow rate as shown by a dotted line in FIG. 1 so that fuel pressure is target fuel pressure because fuel pressure varies according to a fuel supply flow rate. However, if a current value which flows in the dc electric motor and a target current value are compared and supply current is controlled by feedback as in the present invention, the conventional adjustment according to a fuel supply flow rate is not required and control is remarkably facilitated because fuel pressure is determined by supply current as shown by a full line in FIG. 1.

The reason why adjustment according to a fuel supply flow rate is not required when supply current is controlled by feedback is that in the fuel pump provided with the dc electric motor, fuel pressure is in proportion to torque as the characteristic of a pump, torque is in proportion to current as the characteristic of a motor and therefore, this fuel pump provided with the dc electric motor is provided with a characteristic that fuel pressure is in proportion to current.

As in the present invention, the conventional procedure of controlling voltage after fuel pressure is detected is not adopted and supply current is directly adjusted by comparing current values, the present invention has an advantage that processing speed for control is quick and responsiveness is excellent.

Further, as the present invention adopts a returnless system which can save excessive fuel and only control of supply current is required, it is advantageous in view of the constitution of a system and energy.

According to the present invention, the flow rate of fuel supplied by the fuel pump is controlled based upon the operational state of an internal combustion engine by a fuel supply flow rate detecting means, and the amount of injected fuel is controlled by a fuel injection control means target value of injected fuel by adjusting elements related to injection of fuel according to a fuel supply flow rate.

In a system in which supply current is controlled, fuel pressure can be controlled basically based upon supply current so that it is approximately a desired value, however, fuel pressure actually varies (though a little, compared with the case in which voltage is controlled) according to a fuel supply flow rate as shown by an alternate long and short dash line in FIG. 1 because of loss of fluid.

Accordingly, in the present invention, for example the time in which fuel is injected while a fuel injection valve is opened and elements related to the injection of fuel such as supply current are adjusted according to a fuel supply flow rate obtained based upon a state in which an internal combustion engine is operated so as to control the amount of injected fuel more precisely. Since the amount of injected fuel can be compensated by shortage even if fuel pressure does not reach a target value because a fuel supply flow rate is changed, an appropriate amount of fuel can be injected and supplied.

According to the present invention, a fuel supply flow rate can be also obtained based upon the pulse width of a fuel injection valve and the engine speed.

Since system according to the present invention is a returnless fuel supply system and is constituted so that no excessive fuel is required, the flow rate of fuel supplied from the fuel pump is basically regarded as the amount of injected fuel as it is. That is, a fuel supply flow rate can be obtained based upon the pulse width of the fuel injection valve and the engine speed.

According to the present invention, a fuel supply flow rate can be obtained based upon the intake amount of air.

For example, as the amount of injected fuel (F) also varies in proportion to the change of the intake amount of air (A) if control based upon keeping an air-fuel ratio (A/F) fixed is performed, a fuel supply flow rate (the amount of injected fuel) can be obtained based upon the intake amount of air.

According to the present invention, a fuel supply flow rate can be further obtained based upon the rotating speed of the fuel pump.

That is, as a fuel supply flow rate is increased in proportion to the rotating speed of the fuel pump, a fuel supply flow rate can be obtained based upon the rotating speed of the fuel pump.

According to the present invention, the time in which fuel is injected while the fuel injection valve is opened is set to the time of injection in which the fluctuation of pressure (for example, due to loss of fluid) according to a fuel supply flow rate is allowed.

That is, as described above, as fuel pressure varies a little when a fuel supply flow rate is varied due to loss of fluid, an appropriate fuel injection amount can be always set if the time of injection in which the fluctuation of pressure is allowed is set.

According to the present invention, the time of injection can be set so that as a fuel supply flow rate is increased, the time of injection is longer.

Since this fuel supply system, fuel pressure is normally gradually lowered as a fuel supply flow rate is increased, an appropriate fuel injection amount can be readily set by simple setting that the time of injection is extended as a fuel supply flow rate is increased.

According to the present invention, the pulse width of the fuel injection valve set according to a state in which an internal combustion engine is operated is compensated based upon a fuel supply flow rate.

As described above, the relationship that as a fuel supply flow rate is increased, fuel pressure is reduced (see FIG.2) exists between a fuel supply flow rate and fuel pressure, however, this is because as described above, as the fuel supply flow rate of the fuel pump is increased, loss of fluid and others are increased. In the meantime, as the pulse width of the fuel injection valve which determines the amount of injected fuel set according to a state of the operation is calculated on the assumption of fixed fuel pressure, the amount of injected fuel is reduced when a fuel supply flow rate is increased.

Accordingly, according to the present invention, control that as a fuel supply flow rate is increased, the pulse width of the fuel injection valve is also increased is performed by compensating the pulse width of the fuel injection valve according to a fuel supply flow rate so that the amount of injected fuel calculated according to a state of the operation is precisely injected. Even if fuel pressure is reduced because of the increase of a fuel supply flow rate, an appropriate amount of fuel can be always supplied by injection.

According to the present invention, fuel pressure is estimated based upon a fuel supply flow rate and the pulse width of the fuel injection valve is compensated based upon this estimated fuel pressure.

That is, as the relationship shown in FIG. 2 exists between a fuel supply flow rate and fuel pressure in the fuel pump, an appropriate amount of fuel can be supplied by injection by estimating fuel pressure based upon a fuel supply flow rate and compensating the pulse width of the fuel injection valve based upon this fuel pressure.

According to the present invention, supply current in which the fluctuation of pressure (for example, due to loss of fluid) according to a fuel supply flow rate is allowed is set.

That is, as described above, as fuel pressure varies a little when a fuel supply flow rate is varied due to loss of fluid and others, an appropriate fuel injection amount can be always set if supply current is set so that it is target fuel pressure in which the fluctuation of pressure is allowed.

According to the present invention, supply current is set so that it is increased as a fuel supply flow rate is increased.

As in this fuel supply system, fuel pressure is normally gradually lowered as a fuel supply flow rate is increased, an appropriate fuel injection amount can be readily set by simply setting that as a fuel supply flow rate is increased, supply current is increased to prevent fuel pressure from being reduced.

According to the present invention, target current to be supplied to the dc electric motor for driving the fuel pump is also compensated based upon a fuel supply flow rate to keep fuel pressure at a fixed value. Accordingly, the target current can be set easily thereby absorbing the pressure fluctuation easily.

As shown in FIG. 3, the above-described relationship that as a fuel supply flow rate is increased, fuel pressure is lowered exists between a fuel supply flow rate and fuel pressure. (Pressure before compensation: dotted line) In the meantime, supply current is controlled so that it is normally a fixed value. (Current before compensation: dotted line) However, as fuel pressure is lowered when a fuel supply flow rate is increased, the amount of injected fuel is reduced.

Accordingly, according to the present invention, as fuel pressure can be kept a fixed value (pressure after compensation full line) by compensating supply current according to a fuel supply flow rate (current after compensation: full line), fuel in an appropriate injection amount can be always supplied.

According to the present invention, further, supply current is compensated based upon the relationship obtained beforehand between a fuel supply flow rate and fuel pressure.

That is, as the relationship between a fuel supply flow rate and fuel pressure is known beforehand, supply current can be suitably compensated according to the change of a fuel supply flow rate by storing supply current, for example keeping fuel pressure fixed in a map and an arithmetic expression beforehand.

According to the present invention, further, supply current is compensated based upon the relationship obtained beforehand between the rotating speed of the fuel pump and fuel pressure That is, as the rotating speed of the fuel pump corresponds to a fuel supply flow rate and the relationship between the rotating speed of the fuel pump and fuel pressure is known beforehand, supply current can be suitably compensated according to the change of the rotating speed of the fuel pump by storing supply current, for example keeping fuel pressure fixed in a map and an arithmetic expression beforehand.

According to the present invention, if a fuel supply flow rate is smaller than the reference fuel supply flow rate to the fuel pump, the supply current of the fuel pump is increased.

As shown in FIG. 4, the supply current of the dc electric motor and the torque of the fuel pump are proportional. If the dc electric motor is controlled so that the rotating speed thereof is fixed in the fuel pump, a current value thereof is set to a minimum value to reduce power consumption. The above-described setting normally causes no problem. However, if foreign matter should be put into the rotating portion of the pump, torque enough to remove the foreign matter is not generated because the current value is low.

Accordingly, according to the present invention, if supply current is in an area in which no fuel is supplied even if the fuel pump is rotated (shown by an oblique lining in FIGS. 5A and 5B), supply current is increased as a, b and c in FIG. 5. Hereby, as torque is increased, the force to remove the foreign matter is increased. Hereby, torque when the system is started can be also increased. In this case, as a fuel supply flow rate is unchanged, no unprepared fluctuation of fuel pressure and of a fuel injection amount due to the increase of a fuel supply flow rate is caused.

According to the present invention, a check valve is provided on the discharge side of the fuel pump and the pressure for opening this check valve is variable.

That is, the relationship shown in FIG. 6 exists between a fuel supply flow rate and fuel pressure and a graph showing the relationship is shifted by the quantity shown by b by adjusting the pressure for opening the check valve. When the pressure for opening the valve is reduced, the graph is shifted left and when the pressure for opening the valve is increased, the graph is shifted right. Therefore, the relationship between a fuel supply flow rate and fuel pressure can be adjusted by adjusting the pressure for opening the check valve.

According to the present invention, the check valve and a relief valve are provided, for example in the shape of a bidirectional valve on the inflow side of the delivery pipe and the pressure for opening this relief valve is set to a little higher pressure than fuel vapor pressure. Therefore, no bubble is generated in fuel and leakage from the fuel injection valve caused by excessive fuel pressure can be prevented.

That is, as shown in FIG. 7, as saturated vapor pressure varies as the temperature of fuel is varied, a bubble is generated in fuel as the temperature of fuel rises if the pressure for opening the relief valve is set to a low value. In the meantime, when the pressure for opening the valve is set to a high value so that no bubble is generated even if the temperature of fuel rises, fuel readily leaks from the fuel injection valve because fuel pressure is always set to a high value.

Accordingly, according to the present invention, a bubble can be prevented from being generated by setting the pressure for opening the relief valve to a little higher value than saturated vapor pressure and fuel can be also prevented from leaking from the fuel injection valve.

According to the present invention, as the area of a bypass passage is adjustable by screwing and others, the characteristics of the fuel pump, more specifically the relationship between a fuel supply flow rate and fuel pressure, can be adjusted.

That is, the relationship shown in FIG. 6 exists between a fuel supply flow rate and fuel pressure and a graph showing the relationship is shifted by the quantity shown by a by adjusting a bypass flow rate (the area of the bypass passage). When a bypass flow rate is reduced, the graph is shifted upward and when a bypass flow rate is increased, the graph is shifted downward. Therefore, the relationship between a fuel supply flow rate and fuel pressure can be adjusted by adjusting a bypass flow rate.

According to the present invention, a fixed restrictor for restricting a fuel flow rate by an orifice and a movable restrictor for restricting a fuel flow rate by varying the cross-sectional area of the passage by moving itself by, for example screwing are provided to a bypass flow rate regulating valve arranged in the bypass passage in series.

Therefor, according to the present invention, the change of a bypass flow rate for displacement of the valve in the axial direction is gentle as shown by graphs a and b in FIG. 8C, compared with the case that only the movable restrictor is provided as shown by a in FIG. 8A and the case that only an orifice is provided as shown by b in FIG. 8B and the fine adjustment of a bypass flow rate can be readily performed.

According to the present invention, as the movable restrictor is moved in the axial direction by screwing and provided with a conic tapered portion for changing the cross-sectional area of the passage, the fine adjustment of a fuel supply flow rate can be performed by moving this tapered portion in the axial direction by, for example screwing the valve itself.

The present invention relates to a method of adjusting a returnless fuel supply system for an internal combustion engine, in a rotating speed adjusting process the rotating speed of the fuel pump is adjusted to the reference rotating speed of the fuel pump, in a pressure adjusting process the fuel supply pressure (the discharge pressure) of the fuel pump is adjusted to the reference fuel supply pressure and in a flow rate adjusting process the fuel supply flow rate (the discharge flow rate) of the fuel pump is adjusted to the reference fuel supply flow rate. Adjustment corresponding to the characteristics of the fuel pump and the dispersion of circuits can be precisely made according to this adjusting method, for example when shipped from a plant.

The present invention relates to a method of adjusting a returnless fuel supply system for an internal combustion engine, the fuel supply flow rate of the fuel pump is obtained by a fuel supply flow rate calculating means, target rotating speed of the fuel pump is obtained based upon this fuel supply flow rate by a target rotating speed calculating means and the current value of the dc electric motor for driving the fuel pump is controlled by a current value adjusting means so that the actual rotating speed of the fuel pump is close to the target rotating speed of the fuel pump obtained by the target rotating speed calculating means.

A returnless fuel supply system for an internal combustion engine adjusted according to a method of adjusting the returnless fuel supply system for an internal combustion engine can be readjusted. That is, as the characteristics of the fuel pump may be varied when the system is actually operated even if its fuel pump is once adjusted when the system is shipped, adjustment corresponding to the change of the characteristics can be precisely made according to the present invention.

DESCRIPTION OF THE PREFERRED EMBODIMENTS

Figure 1:
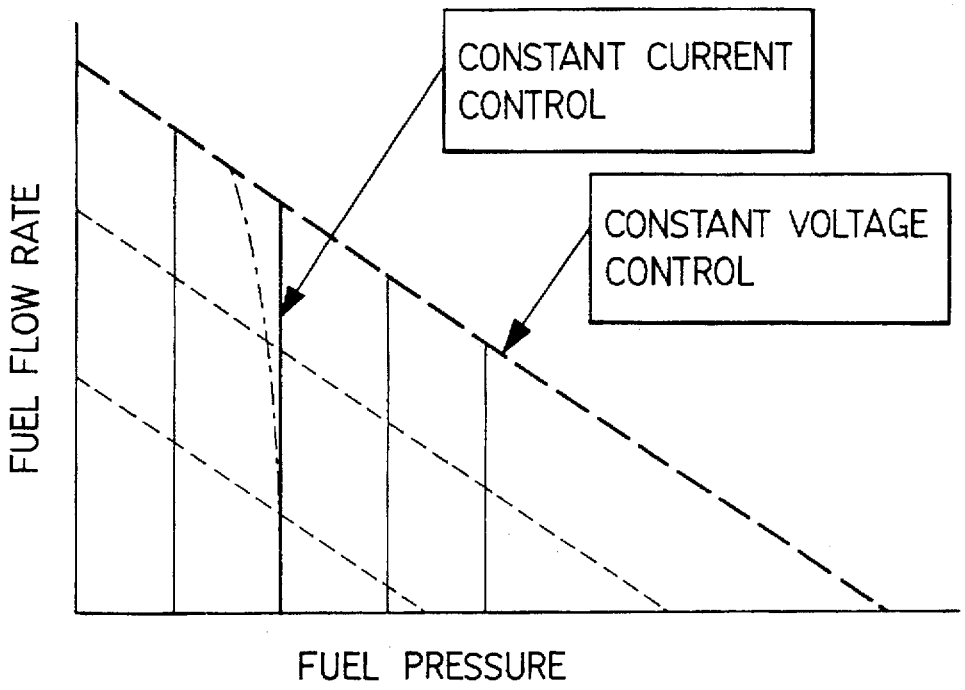
FIG. 1 is a graph showing the relationship between fuel supply flow rate and fuel pressure in controlling current and voltage.
Figure 4:
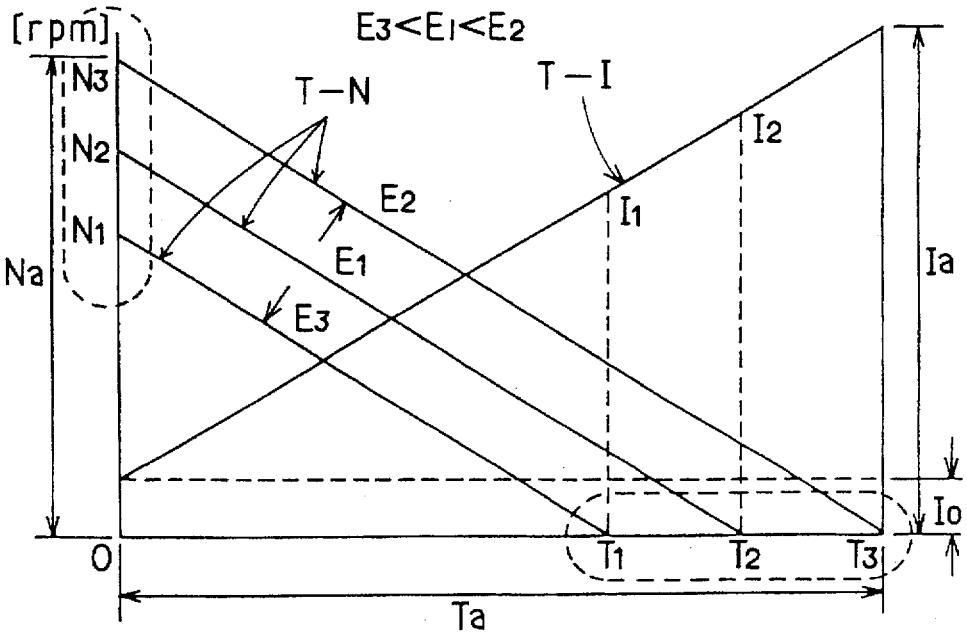
FIG. 4 is a graph showing the relationship among the voltage, the current and the torque of a fuel pump.

Embodiments of a fuel supply system for a returnless internal combustion engine and a method of regulating fuel supply according to the present invention will be described below referring to the drawings.

Figure 9:
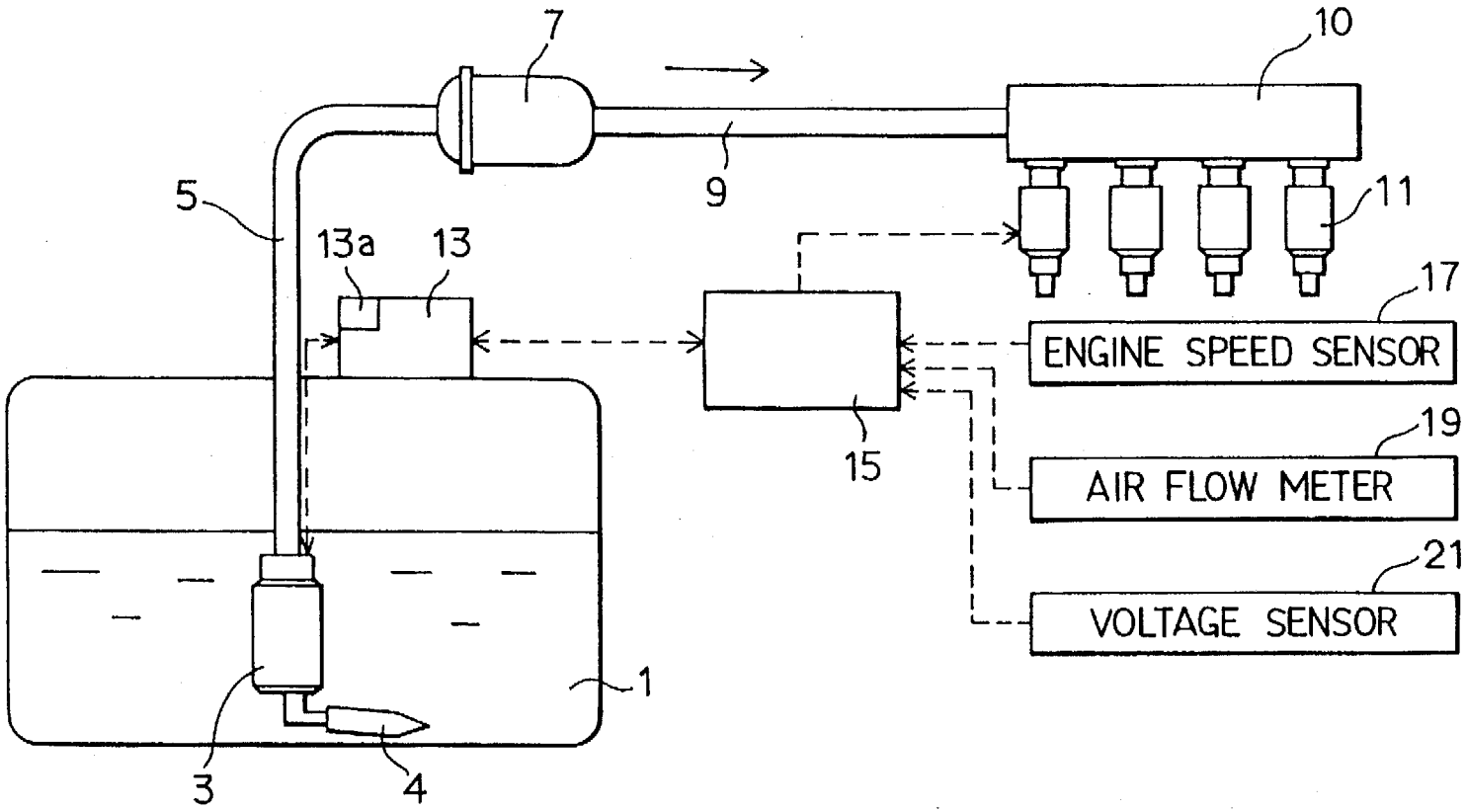
FIG. 9 is a system block diagram of a fuel supply system for a returnless internal combustion engine equivalent to a first embodiment.

(First Embodiment)

a) FIG. 9 is a system block diagram showing a fuel supply system for a returnless internal combustion engine (hereinafter called only a fuel supply system) equivalent to this embodiment.

As shown in FIG. 9, the fuel supply system is constituted by a fuel pump 3 arranged in a fuel tank 1, a low pressure fuel filter 4 connected to the suction side of the fuel pump 3, a high pressure fuel filter 7 connected to the discharge side of the fuel pump 3 via a fuel pipe 5, a fuel rail (delivery pipe) 10 connected to the discharge side of the high pressure fuel filter 7 via a fuel pipe 9, a fuel injection valve 11 arranged on the fuel rail 10 by the number of cylinders for injecting and supplying fuel toward the intake port of the internal combustion engine not shown, a constant current type control circuit 13 for controlling power supplied from a battery not shown to the fuel pump 3 by controlling current and an electronic control unit (ECU) 15 for controlling the fuel injection valve 11 and the constant current type control circuit 13.

This ECU 15 is provided with well-known ROM, RAM, backup RAM, CPU, an I/O device not shown and a bus line for connecting them. An engine speed sensor 17 for detecting engine speed, an airflow meter 19 for detecting the amount of intake air and a voltage sensor 21 for detecting the voltage of the battery are connected to the I/O device and their detection signals are input to the I/O device. The constant current type control circuit 13 and the fuel injection valve 11 are connected to this I/O device and a control signal is output to them. The constant current type control circuit 13 is provided with a pump rotating speed detector 13a for detecting the rotating speed of the fuel pump 3 based upon the pulsation of current and the detected result is reported to ECU 15. In more detail, the pump rotating speed detector 13 has a counter which counts the number of the pulses coming through a filter.

In the above-described system, foreign matter is removed by the low pressure fuel filter 4 when fuel is pumped up by the fuel pump 3 arranged in the fuel tank 1 and the fuel pumped up by this fuel pump 3 is fed to the high pressure fuel filter 7 via the fuel pipe 5. Minute foreign matter and moisture included in fuel are removed by the high pressure fuel filter 7 and this filtered fuel is fed into the fuel rail 10 via the fuel pipe 9. High pressure fuel supplied to the fuel rail 10 is injected from the fuel injection valve 11 into the intake port not shown of the internal combustion engine.

Particularly, as this fuel supply system is a returnless supply fuel system, the fuel supply system is not provided with a return pipe for returning fuel from the fuel rail 10 to the fuel tank 1. Therefore, in this embodiment, current supplied to the pump motor (dc motor) of the fuel pump 3 is controlled by the constant current type control circuit 13 so that fuel pressure in the fuel rail 10 is fixed for the amount of fuel injected from the fuel rail 10.

To put it more concretely, the desired value of current supplied to the pump motor is set so that fuel pressure is desired fuel pressure set according to a state in which the internal combustion engine is operated, the value of current which actually flows in the pump motor (a detected current value) is measured and supply current is feedback-controlled by comparing this detected current value and a desired current value in a well-known manner so that the detected current value becomes equal to the desired current value.

b) Next, the constitution of the fuel pump 3 in the above-described system will be described below.

Figure 10:
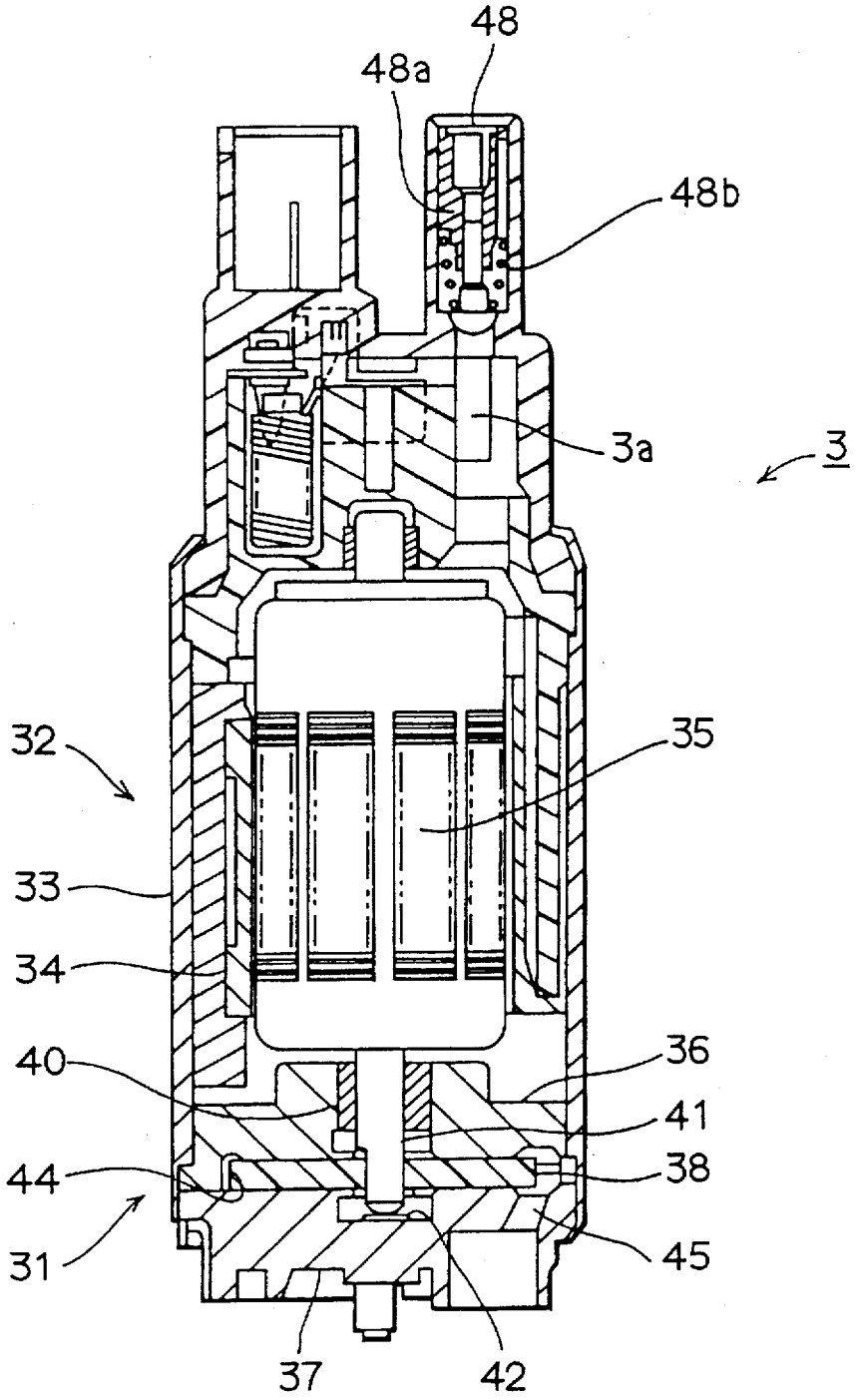
FIG. 10 is a sectional view showing a fuel pump in the first embodiment.

FIG. 10 is a sectional view showing the fuel pump 3.

The fuel pump 3 is constituted by a pump 31 and a motor 32 for driving this pump 31. This motor 32 is a dc motor with a brush and is constituted so that a permanent magnet 34 is arranged in a circle in its cylindrical housing 33 and an armature 35 is arranged concentrically on the inner peripheral side of this permanent magnet 34.

Next, the constitution of the pump 31 will be described.

The pump 31 is constituted by a casing body 36, a casing cover 37 and an impeller 38 and the casing body 36 and the casing cover 37 are formed by, for example die-casting aluminum. The casing body 36 is press-fitted and fixed to/at one end of the housing 33, and the rotating shaft 41 of the armature 37 pierces a bearing 40 fitted to the center of the casing body and is supported by the bearing. In the meantime, the casing cover 37 is fixed at one end of the housing 33 by caulking with it covered on the casing body 36. A thrust bearing 42 is fixed in the center of this casing cover 37 to receive the thrust load of the rotating shaft 41. One casing is constituted by the casing body 36 and casing cover 37 and inside it, the impeller 38 is housed so that it can be rotated.

An arc pump passage 44 is formed on the inner side of the casing body 36 and the casing cover 37. An inlet port communicating with one end of the pump passage 44 is formed on this casing cover 37, a discharge port 46 communicating with the other end of the pump passage 44 is formed on the casing body 36 and this discharge port 46 communicates with space inside the motor 32 through the casing body 36.

Therefore, fuel discharged from the discharge port 46 is discharged from the fuel discharge port 48 provided on the other side of the housing 33 through the space inside the motor 32.

Further, the above-described fuel discharge port 48 is provided with a check valve 48*a* opened when predetermined pressure is applied and a valve opening spring 48*b* for regulating fuel discharge pressure by pressing the check valve 48*a*. This check valve 48*a* is provided for regulating the characteristics of the fuel pump 3. The concrete, the relationship between fuel supply flow rate and fuel pressure as shown by b in FIG. 6.

The valve opening spring 48*b* can be replaced and the characteristics of the fuel pump 3 can be changed by replacing this valve opening spring 48*b*. In this embodiment, the valve opening spring 48*b* is constituted so that it can be replaced, however, it may be constituted so that valve opening pressure is regulated by a screw.

c) Next, the operation of the fuel supply system will be described.

(1) First, the feedback control of supply current will be described referring to a flowchart shown in FIG. 11. This flowchart repeats at a prescribed interval.

Figure 11:
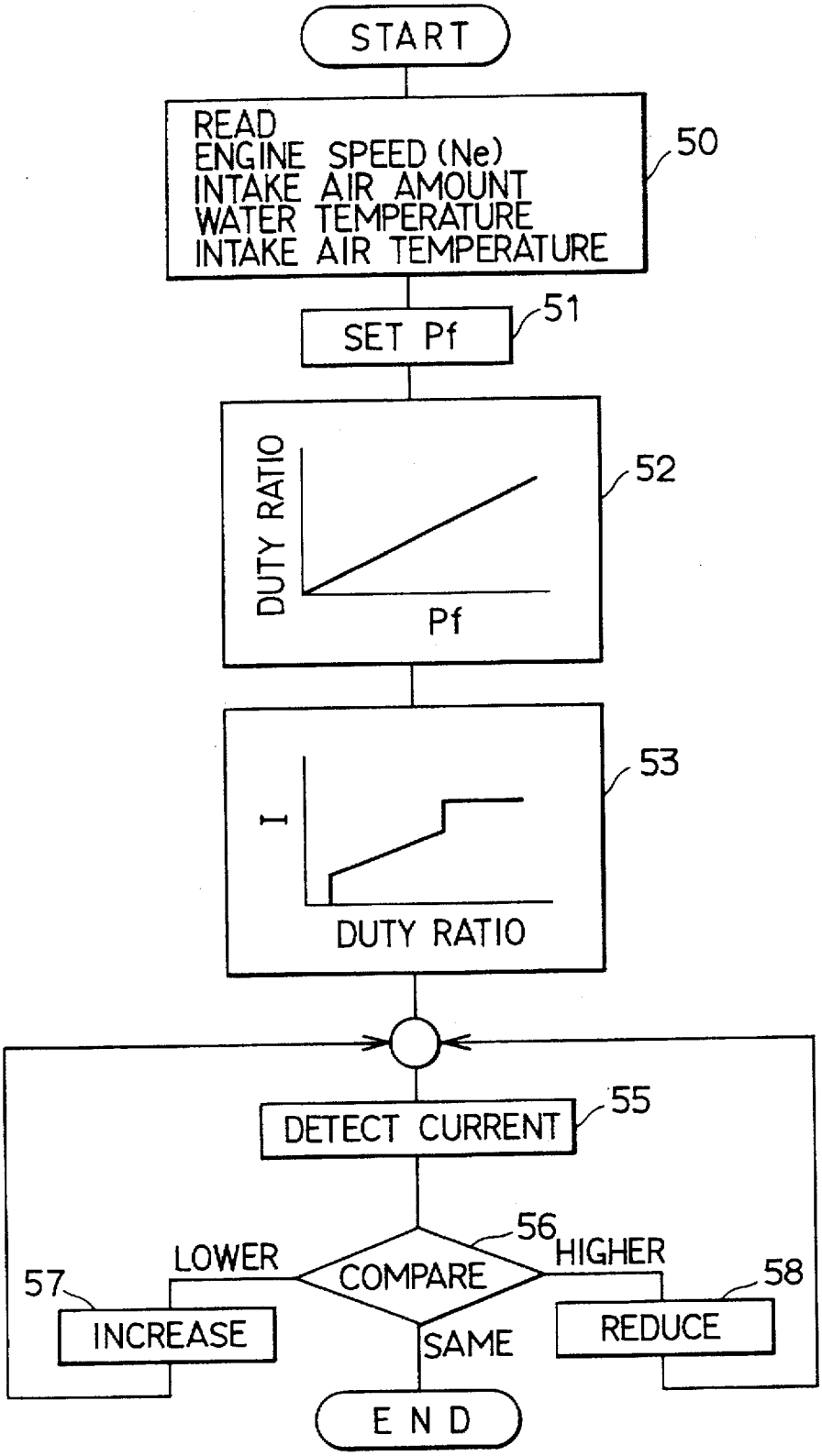
FIG. 11 is a flowchart showing a part of control processing in the first embodiment.

In steps 50 and 51 in FIG. 11, desired or target fuel pressure is set according to a state in which the internal combustion engine is operated. It is judged, in the step 50, which the current state of operation is of, for example a general running state, a high temperature restarted state and a full speed state based upon, for example the engine speed, the amount of intake air, the cooling water temperature and the intake air temperature and suitable target fuel pressure is set using a map showing the relationship between the state of operation and target fuel pressure according to each state of operation in the step 51.

In the next step 52, duty is obtained from target fuel pressure based upon a map showing the relationship between target fuel pressure and duty.

Thereafter, the target fuel pressure is converted into a pulse signal to calculate the target current value. For this purpose, the duty ratio of the pulse signal is given from a map showing the relationship between the target fuel pressure and the duty ratio of the pulse signal in the step 52. The duty ratio stored in the map increases linearly with increase of the target fuel pressure.

Then, in a step 53, the target current value is determined. The duty ratio stored in this map increases linearly to a high value with increase of the target current value and stays at a constant value thereafter regardless of increase of the target current value.

Thus, by setting the duty ratio between the target current value and the target fuel pressure, the signal can be obtained free from noise accurately.

Then, in the next step 55, the actual current supplied to the pump motor is detected.

In the next step 56, the target current value and current (a detected current value) which actually flows in the pump motor are compared. If current which actually flows in the pump motor is detected, a current detecting circuit is arranged in, for example a conductor portion connected to the pump motor and current which flows in the pump motor is detected by this current detecting circuit.

Thereafter, supply current is controlled so that there is no difference between the target current value and a detected current value. If the target current value is larger than a detected current value by a predetermined value, supply current is controlled in step 57 so that it is increased by the predetermined value. For example, the duty ratio of the voltage applied to the pump motor is controlled (so called duty ratio control).

If the target current value is smaller than the detected value, a control to decrease the supplied current by such as the duty ratio control is carried out until the detected value becomes equal to the target value.

Next, the constant current type control circuit 13 for controlling the electric motor of the fuel pump 3 will be described referring to FIG. 27.

Figure 27:
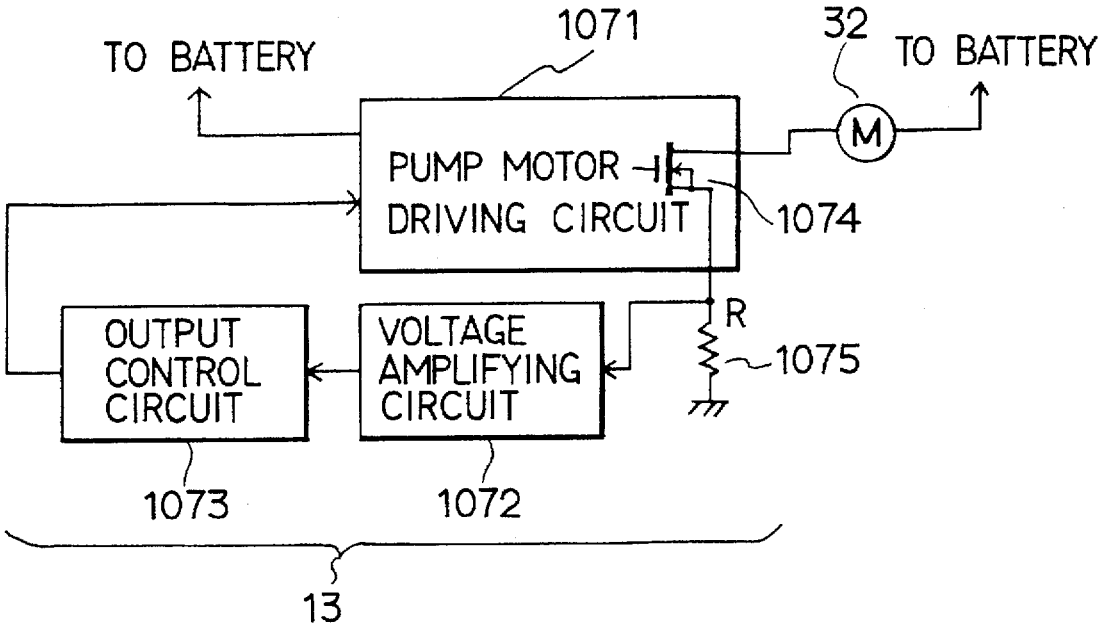
FIG. 27 is a block diagram showing a constant current type control circuit in a fuel supply system for an internal combustion engine equivalent to the thirteenth embodiment.

As shown in FIG. 27, the constant current type control circuit 13 is constituted by a pump motor driving circuit 1071, a voltage amplifying circuit 1072, an output control circuit 1073 and a current detecting resistor 1075.

The pump motor driving circuit 1071 controls the on and off of voltage supplied from a battery not shown to a pump motor 32 as the electric motor of the fuel pump 3 via a switching element 1074. The on-off control by this pump motor driving circuit 1071 is controlled by the output control circuit 1073. This output control circuit 1073 controls the pump motor driving circuit 1071 by converting current which flows in the pump motor 32 to voltage by the current detecting resistor 1075 and comparing the voltage by a comparator. That is, as the voltage compared by the comparator in the output control circuit 1073 is high when current which flows in the pump motor 32 is larger than predetermined current, the output control circuit 1073 controls the pump motor driving circuit 1071 so that the pump motor driving circuit 1071 turns off the switching element 1074. Voltage supplied to the pump motor 32 is turned off by such control.

As the voltage compared by the comparator in the output control circuit 1073 is low when current which flows in the pump motor 32 is smaller than predetermined current, voltage is supplied to the pump motor 32 by turning on the switching element 1074. As described above, the constant current of the pump motor 32 is controlled by detecting current which flows in the pump motor 32 by the current detecting resistor 1075.

A predetermined current value used for on-off control of the pump motor 32 is provided with so-called hysteresis characteristics by setting it so that the predetermined current value for turning on the pump motor is lower than the predetermined current value for turning it off. Hereby, an unstable control state caused when a set current value for turning off the pump motor and a set current value for turning it on are the same can be avoided.

As described above, in this processing, as supply current is controlled by feedback based upon the difference between the target current value and a detected current value so that current which actually flows in the pump motor is equal to the target current value, supply current can be controlled so that it is precisely the target current value.

As fuel pressure is approximately in proportion to supply current if supply current to the pump motor is controlled as described above, fuel pressure can be readily set to the target fuel pressure by controlling supply current.

That is, in this embodiment, as approximately desired fuel pressure can be obtained by controlling supply current, the control of changing a voltage value greatly according to fuel supply flow rate as the conventional control of voltage is not required.

As supply current is directly controlled by comparing current values without using the conventional procedure from detecting fuel pressure to controlling voltage, there is an advantage that the processing speed of control is fast and the responsiveness is excellent.

If more precise control is required, the amount of fuel injection is required to be compensated according to fuel supply flow rate as described later, however, as there is an area in which even if fuel supply flow rate, fuel pressure is little unchanged as shown in FIG. 1, the amount of fuel injection may be appropriately compensated if necessary.

(2) Next, the processing for compensating the amount of fuel injection (the pulse width applied to the fuel injection valve) according to fuel supply flow rate will be described referring to a flowchart shown in FIG. 12.

Figure 12:
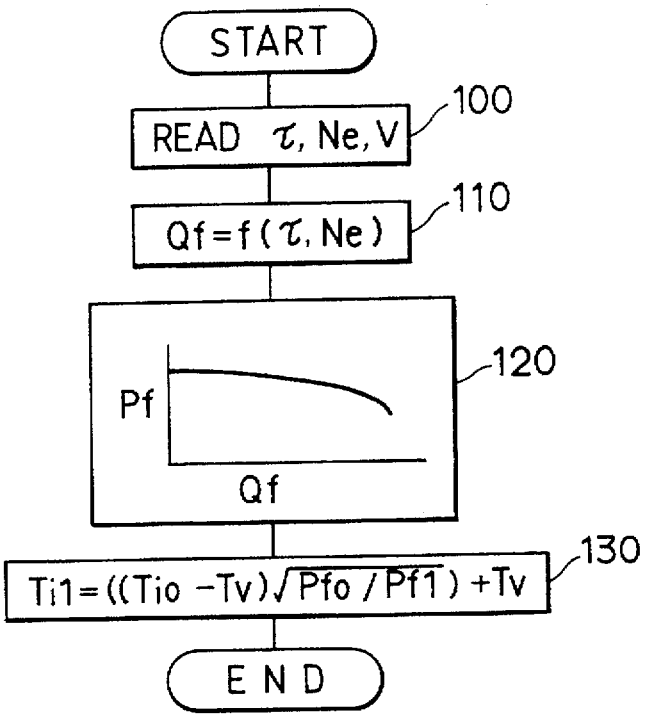
FIG. 12 is a flowchart showing a part of control processing in the first embodiment.

In a step 100 in FIG. 12, the pulse width $\tau$ of the fuel injection valve set according to a state in which the internal combustion engine is operated is read from RAM, the engine speed Ne obtained from a signal from the engine speed sensor 17 is read and the voltage V of the battery obtained from a signal from the voltage sensor 21 is read. The pulse width applied to the fuel injection valve operating condition of the engine is obtained from the following expression.

$$Ti=KQ/2n\cdot Ne+Tv$$

where Tv: a invalid pulse width, K: a constant decided by the engine temperature, vacuum pressure, intake air temperature and the atmospheric pressure, Q: intake air flow rate, Ne: engine speed, (n) the number of cylinders.

In the next step 110, as the system equivalent to this embodiment is returnless, fuel supply flow rate (the amount of fuel injection) Qf is calculated using the pulse width t of the fuel injection valve and the engine speed Ne obtained in the above step 100 according to the following expression (4), that is, the above expression (2):

$$Qf=f(\tau,Ne) \quad (4)$$
$$=(Ne/2)\times k\tau\cdot S \quad (2)$$

In the next step 120, fuel pressure Pf is obtained based upon fuel supply flow rate Qf calculated according to the above expression (4) using a map showing the relationship between fuel supply flow rate Qf and fuel pressure Pf stored in the above ROM. The target fuel pressure Pf stored in the map decreases with increase of the fuel flow rate Qf.

In the next step 130, the pulse width $\tau$ of the fuel injection valve is compensated using the following expression (5): The fuel pressure Pf0 before compensation is equivalent to the fuel pressure Pf obtained in the above step 120 and the pulse width Ti0 before compensation is equivalent to the pulse width $\tau$ of the fuel injection valve obtained in the above step 100.

[Expression 2]

$$Ti1 = ((Ti0 - Tv) - \sqrt{Pfo/pf1}) + Tv \quad (5)$$

where

Ti1: pulse width after compensation

Ti0: pulse width before compensation

Tv: Invalid pulse width calculated based upon the voltage of a battery)

Pf0: Fuel pressure before compensation

Pf1: Fuel pressure after compensation

That is, the pulse width after compensation Ti1 is obtained based upon the pulse width before compensation Ti0, the invalid pulse width Tv, fuel pressure before compensation Pf0 and fuel pressure after compensation Pf1 and this procession is once terminated.

As described above, in this embodiment, fuel supply flow rate Qf is obtained based upon the pulse width τ of the fuel injection valve and the engine speed Ne using the expression (4), fuel pressure Pf is obtained based upon this fuel supply flow rate Qf using the above map and the pulse width after compensation Ti1 is calculated based upon this fuel pressure Pf (=Pf0), the voltage V of the battery and the pulse width τ (=Ti0) of the fuel injection valve using the expression 5).

Figure 2A:
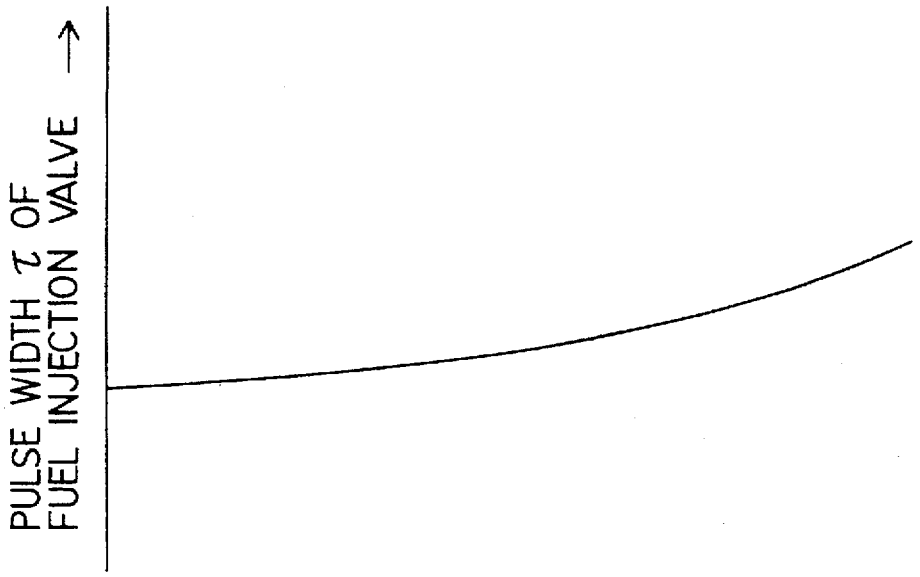
FIGS. 2A and 2B are graphs showing the relationship among fuel supply flow rate, fuel pressure and the pulse width of a fuel injection valve.
Figure 2B:
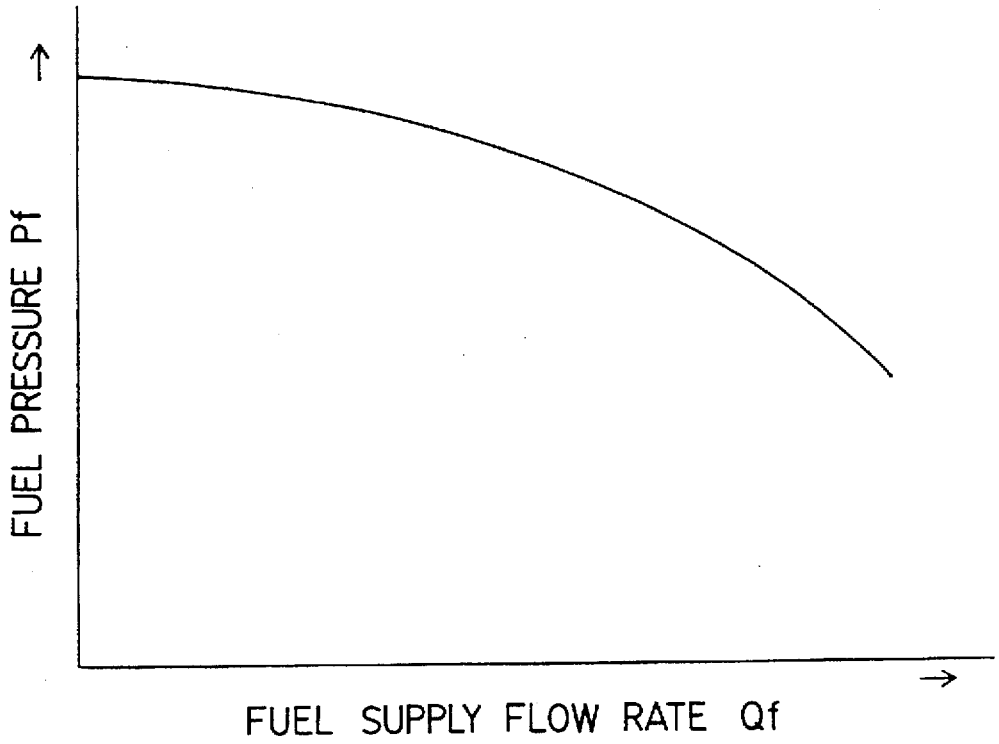

Therefore, as shown in FIG. 2, even if fuel pressure Pf is reduced as fuel supply flow rate is increased, fuel equivalent to the amount of fuel injection required according to a state in which the internal combustion engine is operated can be precisely supplied by injection by appropriately compensating the pulse width τ of the fuel injection valve.

Hereby, excessive fuel from the fuel pump 3 is not required and power consumption can be reduced. Further, as no excessive fuel is circulated in the fuel tank 1, the evaporated amount can be reduced.

Further, as fuel pressure is not required to be measured using a fuel pressure sensor as in the prior art, there is an advantage that the fuel pressure sensor can be omitted.

(Second Embodiment)

Next, a second embodiment will be described.

This embodiment is different from the first embodiment in a method for calculating fuel supply flow rate and is characterized by using air weight flow rate. In this embodiment, the description of the same hardware as in the first embodiment is omitted or simplified, however, the same drawings are also used in this embodiment.

Figure 13:
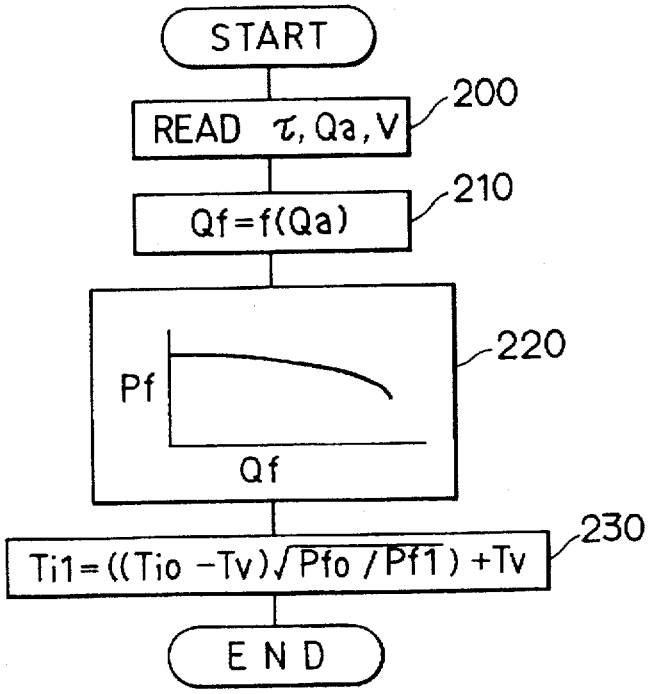
FIG. 13 is a flowchart showing control processing in a second embodiment.

As shown in FIG. 13, in a step 200, the pulse width τ of a fuel injection valve set according to a state in which an internal combustion engine is operated is read from RAM, the air weight flow rate Qa obtained from a signal from an air flow meter 19 is read and the voltage V of a battery obtained from a signal from a voltage sensor 21 is read.

In the next step 210, as it can be thought that fuel supply flow rate Qf is in proportion to air weight flow rate Qa when the air/fuel ratio is fixed according to the definition of an air/fuel ration A/F, the fuel supply flow rate Qf is calculated using the air weight flow rate Qa obtained in the above step 200 in the following expression 6):

$$Qf = f(Qa) = k \cdot Qa \quad (6)$$

where k shows a predetermined coefficient.

In the next step 220, fuel pressure Pf is obtained based upon the fuel supply flow rate Qf calculated according to the above expression (6) using a map showing the relationship between the fuel supply flow rate Qf and the fuel pressure Pf stored in the above-described ROM which is similar to the map described with regard to the step 120.

In the next step 230, the pulse width τ of the fuel injection valve is compensated using the expression (5) described in the step 130 in the first embodiment, the pulse width after compensation Ti1 is obtained and this processing is once terminated.

As described above, in this embodiment, fuel supply flow rate Qf is obtained based upon the air weight flow rate Qa using the expression (6), fuel pressure Pf is obtained based upon this fuel supply flow rate Qf using the above map and the pulse width after compensation Ti1 is calculated based upon this fuel pressure Pf (=Pf0), the voltage V of a battery and the pulse width τ (=Ti0) of the fuel injection valve using the expression (5).

Therefore, as in the first embodiment, even if fuel pressure Pf is reduced as fuel supply flow rate Qf is increased, fuel equivalent to the amount of fuel injection required according to a state in which the internal combustion engine is operated can be precisely supplied by injection.

(Third Embodiment)

Next, a third embodiment will be described.

In order to provide a more accurate control, this embodiment is characterized in that fuel supply flow rate is obtained based upon the pulse width of a fuel injection valve and engine speed instead of compensating the pulse width of the fuel injection valve and the target current value of a fuel pump is obtained based upon this fuel supply flow rate. In this embodiment, the description of the same hardware as in the first embodiment is omitted or simplified, however, the same drawings are also used in this embodiment.

Figure 14:
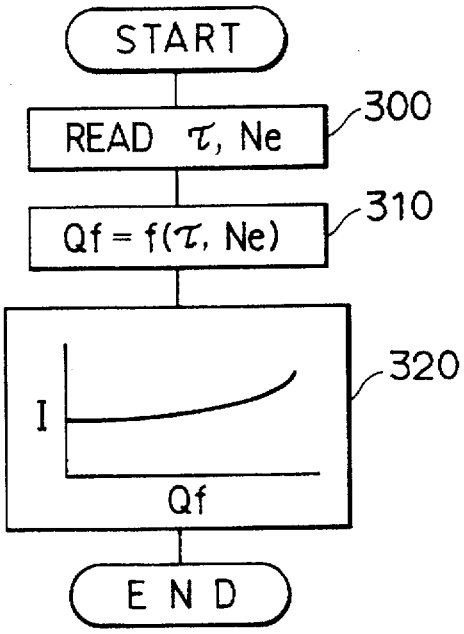
FIG. 14 is a flowchart showing control processing in a third embodiment.

As shown in FIG. 14, in a step 300, the pulse width τ of the fuel injection valve set according to a state in which an internal combustion engine is operated is read from RAM and the engine speed Ne obtained from a signal from an engine speed sensor 17 is read.

In the next step 310, fuel supply flow rate (the amount of. fuel injection) Qf is calculated according to the above expression (4) using the pulse width τ of the fuel injection valve and the engine speed Ne obtained in the above step 300.

$$\begin{aligned} Qf &= f(\tau, Ne) \\ &= (Ne/2) \times k\tau \times S \end{aligned} \quad (4)$$

In the next step 320, a target current value I is obtained based upon the fuel supply flow rate Qf calculated according to the above expression (4) using a map showing the relationship between the fuel supply flow rate Qf and the target current value I of the fuel pump 3 stored in ROM and this processing is once terminated. This map shows the target current value I which increases with increase of the fuel flow rate Qf.

As described above, in this embodiment, fuel supply flow rate Qf is obtained based upon the pulse width τ of the fuel injection valve and the engine speed Ne using the above expression (4) and target current value I is obtained based upon this fuel supply flow rate Qf using the above map.

Figure 3A:
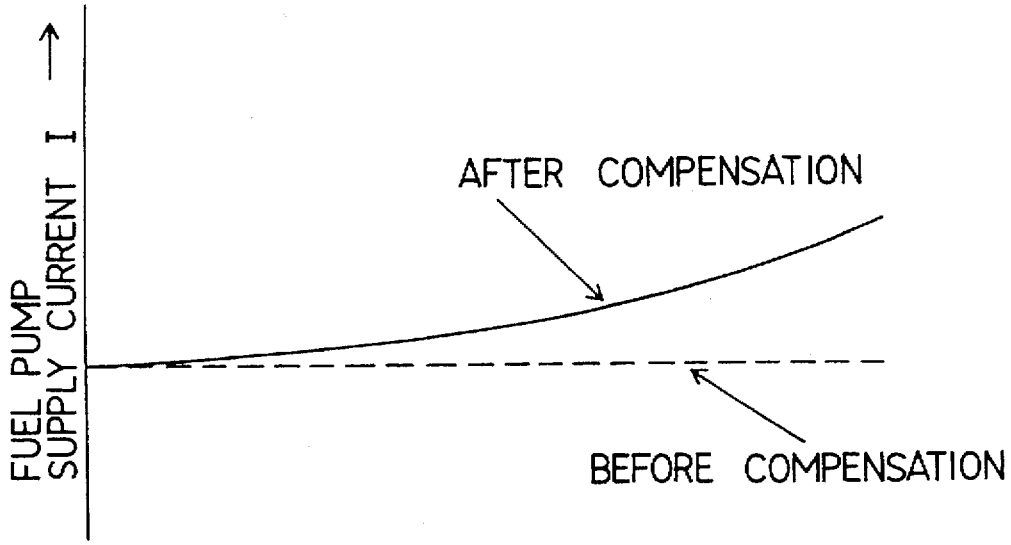
FIGS. 3A and 3B are graphs showing the relationship among fuel supply flow rate, fuel pressure and current supplied to a fuel pump.
Figure 3B:
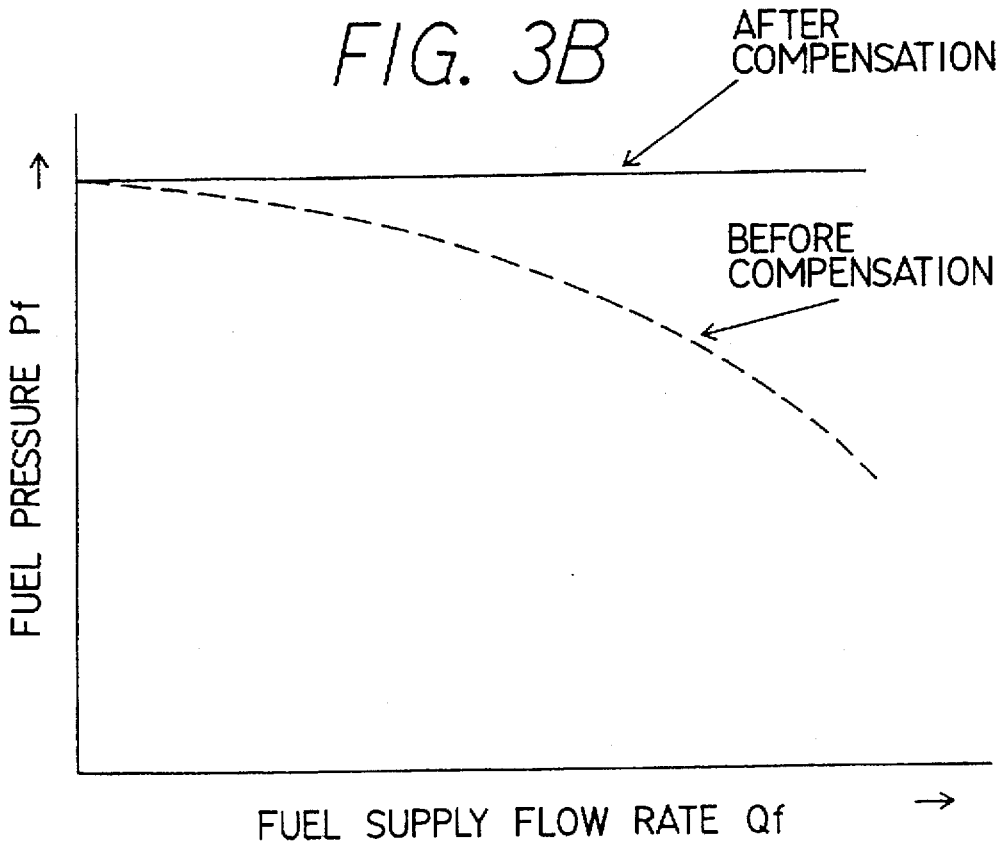

Therefore, as in the first embodiment, even if fuel pressure Pf is reduced as fuel supply flow rate Qf is increased as shown in FIG. 3, fuel equivalent to the amount of fuel injection required according to a state in which the internal combustion engine is operated can be precisely supplied by injection by increasing the target current value I, because the actual current can be controlled to regulate the fuel pressure constant without regard to the fuel supply flow rate.

(Fourth Embodiment)

Next, a fourth embodiment will be described.

This embodiment is characterized in that fuel supply flow rate is obtained based upon the air weight flow rate instead of compensating the pulse width of a fuel injection valve and the supply current of a fuel pump is obtained based upon this fuel supply flow rate. In this embodiment, the description of the same hardware as in the first embodiment is omitted or simplified, however, the same drawings are also used in this embodiment.

Figure 15:
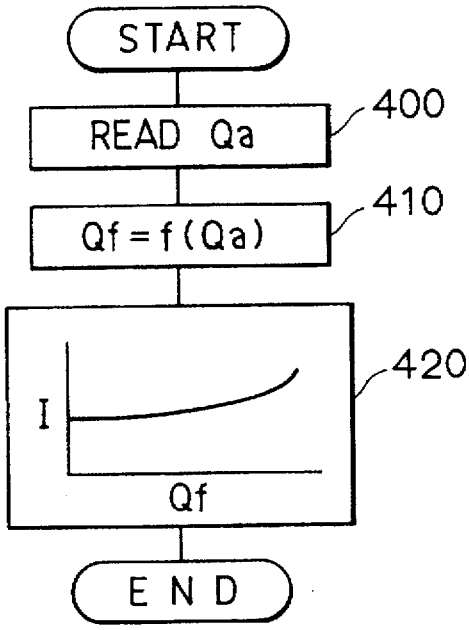
FIG. 15 is a flowchart showing control processing in a fourth embodiment.

As shown in FIG. 15, in a step 400, the air weight flow rate Qa obtained from a signal from an air flow meter 19 is read.

In the next step 410, fuel supply flow rate Qf is calculated based upon the air weight flow rate Qa obtained in the above step 400 according to the above expression (6).

$$Qf=f(Qa)=k\cdot Qa \quad (6)$$

In the next step 420, supply current I is obtained based upon the fuel supply flow rate Qf calculated according to the above expression (6) using a map (as in the step 320 in FIG. 14) showing the relationship between the fuel supply flow rate Qf and the target current value I of the fuel pump 3 stored in the above ROM and this processing is once terminated.

As described above, in this embodiment, fuel supply flow rate Qf is obtained based upon the air weight flow rate Qa using the above expression (6) and the target current value I is obtained based upon this fuel supply flow rate Qf using the above map.

Therefore, as in the third embodiment, even if fuel pressure Pf is reduced as fuel supply flow rate Qf is increased, fuel equivalent to the amount of fuel injection required according to a state in which an internal combustion engine is operated can be precisely supplied by injection by appropriately increasing supply current.

In this embodiment, the above-described air weight flow rate is obtained from an air flow meter, however, a variety of methods such as a method of obtaining air weight flow rate based upon the opening of a throttle and the engine speed or based upon the intake manifold pressure and the engine speed may be adopted.

(Fifth Embodiment)

Next, a fifth embodiment will be described.

This embodiment is different from the first embodiment in a method of calculating fuel supply flow rate and is characterized by using the rotating speed of a fuel pump. In this embodiment, the description of the same hardware as in the first embodiment is omitted or simplified, however, the same drawings are also used in this embodiment.

Figure 16:
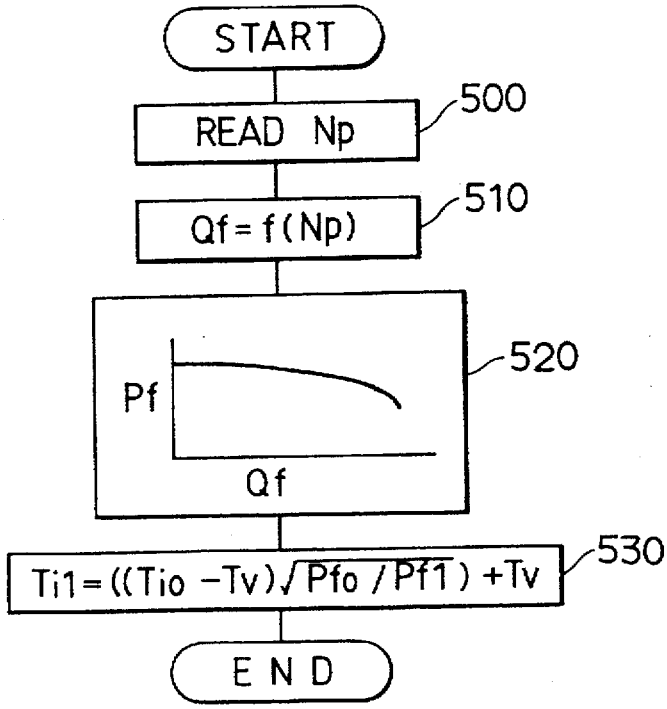
FIG. 16 is a flowchart showing a part of control processing in a fifth embodiment.

As shown in FIG. 16, in a step 500, the pulse width τ of a fuel injection valve set according to a state in which an internal combustion engine is operated is read from RAM and the rotating speed Np of the fuel pump obtained from a signal from a pump rotating speed detector 13*a* of a constant current type control circuit 13 is read. However, as current which flows in the constant current type control circuit 13 pulses according to the rotation of the fuel pump 3, the pump rotating speed detector 13a detects the rotating speed of the fuel pump 3 based upon this pulsation.

In the next step 510, as it can be thought that fuel supply flow rate Qf is in proportion to the rotating speed Np of the fuel pump, fuel supply flow rate Qf is calculated based upon the rotating speed Np of the fuel pump obtained in the above step 500 according to the following expression (7):

$$Qf=f(Np)=k\cdot Np \quad (7)$$

However, k shows a predetermined coefficient.

In the next step 520, fuel pressure Pf is obtained based upon the fuel supply flow rate Qf calculated according to the above expression (7) using a map (as in the step 120 in FIG. 12) showing the relationship between the fuel supply flow rate Qf and the fuel pressure Pf stored in the above ROM.

In the next step 530, the pulse width after compensation Ti1 is obtained by compensating the pulse width τ of the fuel injection valve using the expression (5) described in the step 130 in the first embodiment and this processing is once terminated.

As described above, in this embodiment, fuel supply flow rate Qf is obtained based upon the rotating speed Np of the fuel pump using the expression (7) , fuel pressure Pf is obtained based upon this fuel supply flow rate Qf using the above map and the pulse width after compensation Ti1 is calculated based upon this fuel pressure Pf (=Pf0), the voltage V of a battery and the pulse width τ (=Ti0) of the fuel injection valve using the expression (5).

Therefore, even if fuel pressure is reduced as fuel supply flow rate Qf is increased, fuel equivalent to the amount of fuel injection required according to a state in which the internal combustion engine is operated can be precisely supplied by injection.

(Sixth Embodiment)

Next, a sixth embodiment will be described.

This embodiment is the same as the fifth embodiment in a method of calculating fuel supply flow rate, however, it is different from the fifth embodiment in that the target current value I is obtained. In this embodiment, the description of the same hardware as in the first embodiment is omitted or simplified, however, the same drawings are also used in this embodiment.

Figure 17:
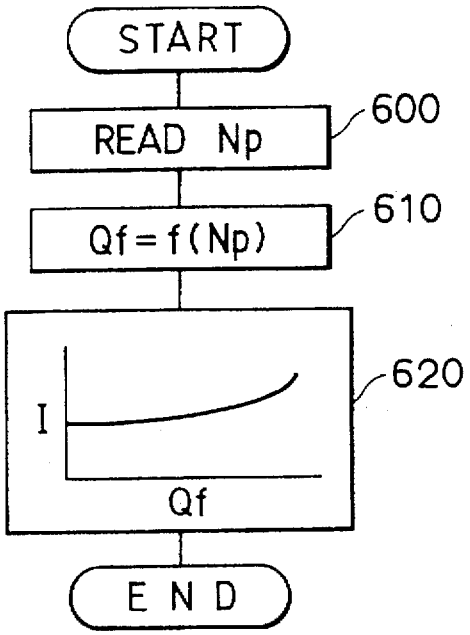
FIG. 17 is a flowchart showing a part of control processing in a sixth embodiment.

As shown in FIG. 17, in a step 600, the rotating speed Np of a fuel pump obtained from a signal from a pump rotating speed detector 13*a* of a constant current type control circuit 13 is read.

In the next step 610, as it can be thought that fuel supply flow rate Qf is in proportion to the rotating speed Np of the fuel pump, fuel supply flow rate Qf is calculated based upon the rotating speed Np of the fuel pump obtained in the above step 600 according to the above expression (7).

In the next step 620, supply current I is obtained based upon the fuel supply flow rate Qf using a map showing the relationship between the fuel. supply flow rate Qf and the supply current I of the fuel pump 3 stored in the above ROM and this processing is once terminated.

As described above, in this embodiment, fuel supply flow rate Qf is obtained based upon the rotating speed Np of the fuel pump using the expression (7) and the target current value I is obtained based upon this fuel supply flow rate Qf using the above map as in the step 320 in FIG. 14.

Therefore, even if fuel pressure Pf is reduced as fuel supply flow rate Qf is increased, fuel equivalent to the amount of fuel injection required according to a state in which an internal combustion engine is operated can be precisely supplied by injection by appropriately increasing supply current I.

(Seventh Embodiment)

Next, a seventh embodiment will be described.

Figures 5A, 5B:
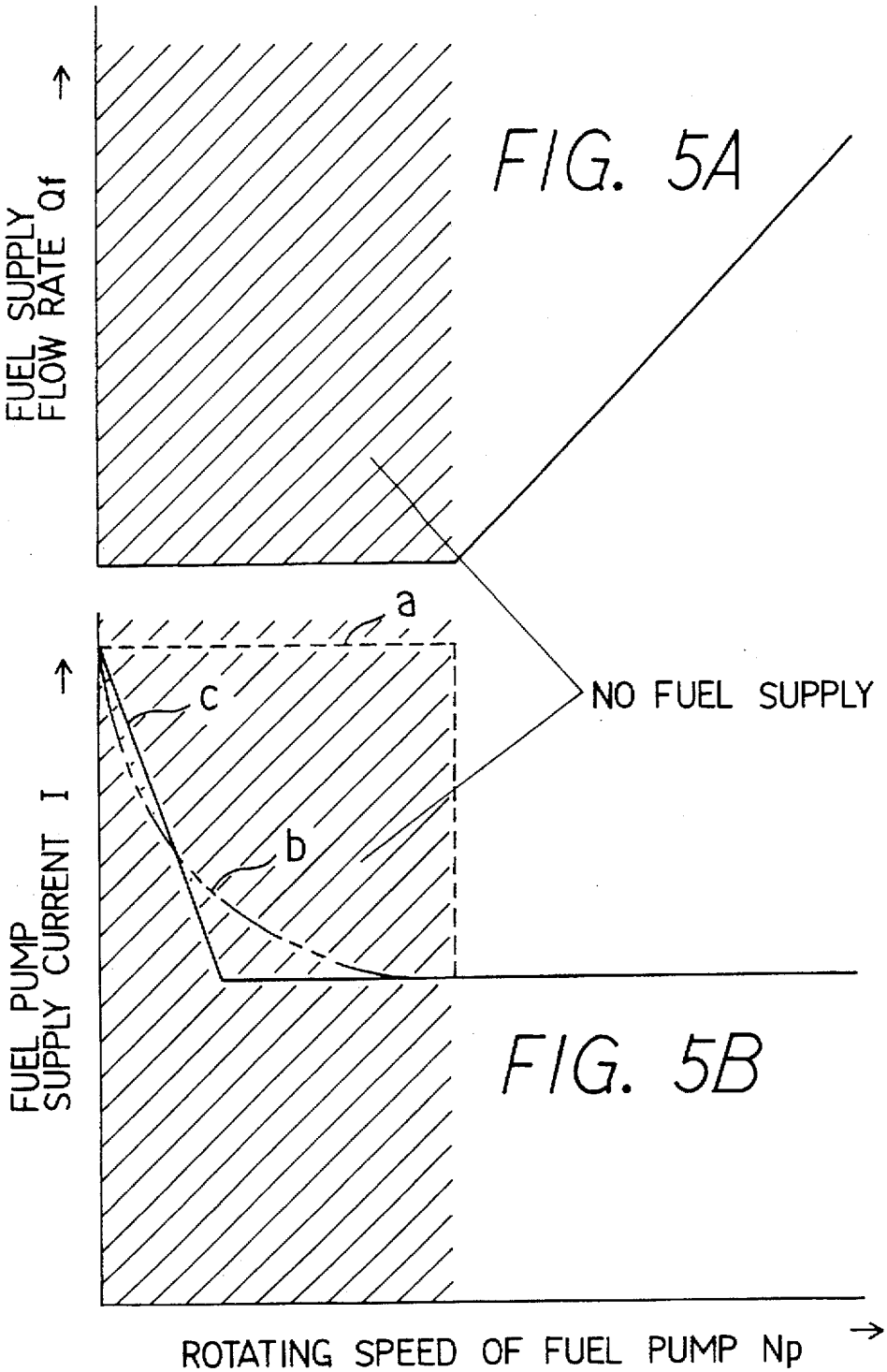
FIGS. 5A and 5B are graphs showing the relationship among the engine speed of a fuel pump, current supplied to the fuel pump and the flow rate of fuel supply.

This embodiment is characterized in that supply current of a fuel pump is constant in an area of the rotating speed of the fuel pump in which fuel is supplied, and is increased in an area of the rotating speed of the fuel pump in which no fuel is supplied as shown in FIG. 5. In this embodiment, the description of the same hardware as in the first embodiment is omitted or simplified, however, the same drawings are also used in this embodiment.

Figure 18:
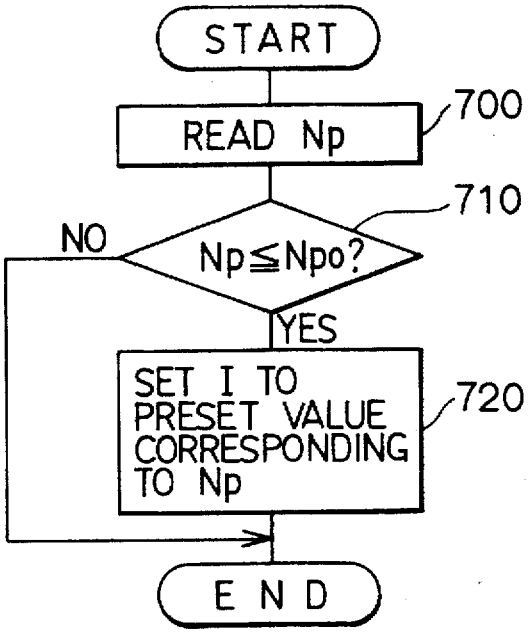
FIG. 18 is a flowchart showing control processing in a seventh embodiment.

As shown in FIG. 18, in a step 700, the rotating speed Np of a fuel pump obtained from a signal from a pump rotating speed detector 13*a* of a constant current type control circuit 13 is read.

In the next step 710, it is judged whether the rotating speed Np of the fuel pump is smaller than a criterion Np0 showing an area of the rotating speed of the fuel pump in which no fuel is supplied or not. When affirmative judgement is made, the processing proceeds to a step 720 and in the meantime, when negative judgement is made, this processing is once terminated.

In a step 720, the current value set by the constant current type control circuit 13 is set as preset supply current so that it has a little higher value than a normal value according to the rotating speed Np of the fuel pump based upon a map or an arithmetic expression and this processing is once terminated.

As described above, in this embodiment, as the target current value I is set so that it has a little higher value, for example as shown by a, b and c in FIG. 5 than a normal current value (that is, a current value in an area of the rotating speed of the fuel pump in which fuel is supplied) if the rotating speed Np of the fuel pump is smaller than a criterion Np0, the torque of the fuel pump 3 is increased. Therefore, there is an advantage that even if a foreign matter should block the portion related to rotation of the fuel pump 3, the foreign matter can be readily removed by driving the above-described portion related to rotation with this large torque.

(Eighth Embodiment)

Next, an eighth embodiment will be described.

This embodiment is characterized in that a bidirectional valve provided with a check valve and a relief valve is used. In this embodiment, the description of the same hardware as in the first embodiment is omitted or simplified, however, the same drawings are also used in this embodiment.

Figure 19:
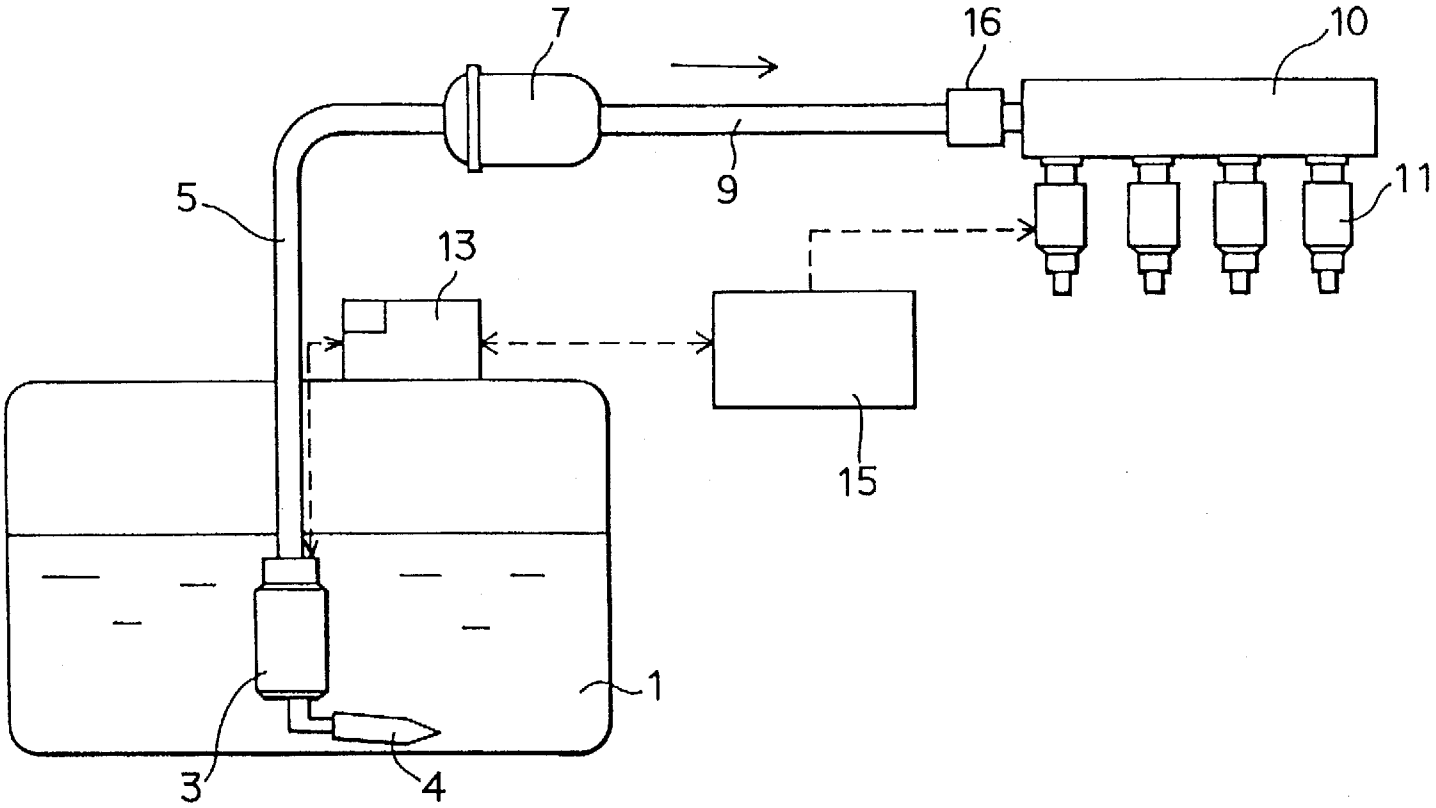
FIG. 19 is a system block diagram showing a fuel supply system for a returnless internal combustion engine equivalent to an eighth embodiment.

As shown in FIG. 19, a fuel supply system is provided with a bidirectional valve 16 in a fuel pipe 9 on the side of a fuel rail 10 in addition to a fuel tank 1, a fuel pump 3, a low pressure fuel filter 4, fuel pipes 5 and 9, a high pressure fuel filter 7, a fuel rail 10, a fuel injection valve 11, a constant current type control circuit 13 and an electronic controller 15.

Figure 20A:
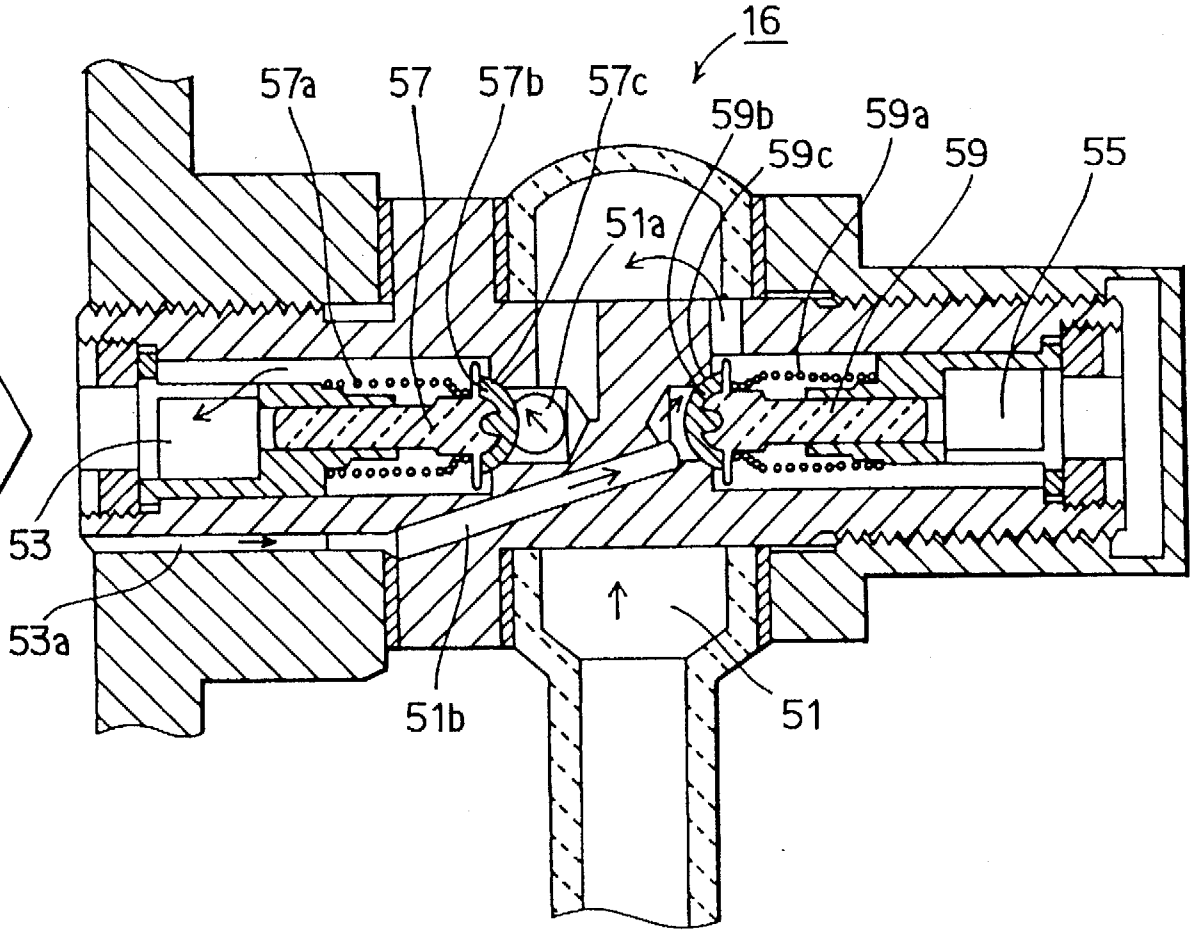
FIGS. 20A and 20B are respectively a sectional view and a left-hand side view showing a bidirectional valve in the eighth embodiment.
Figure 20B:
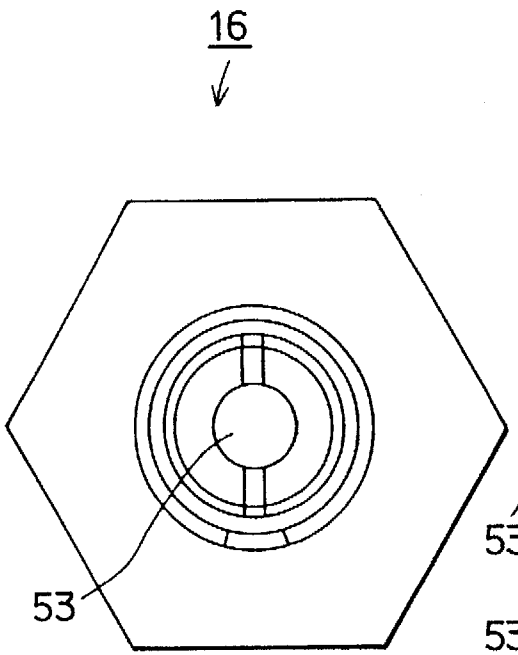

This bidirectional valve 16 is provided with a central chamber 51 connected to the fuel pipe 9, a left chamber 53 and a right chamber 55 connected to this central chamber 51 as shown in FIG. 20. A check valve which is opened when the pressure of fuel which is to flow into the fuel rail 10 is larger than a predetermined value is arranged in the left chamber 53 connected to the fuel rail 10 and a relief valve 59 which is opened when the pressure in the fuel rail 10 is larger than a predetermined value is arranged in the right chamber 55. The pressure for opening the relief valve 59 is set so that it is higher than the pressure for opening the check valve 57.

The above-described check valve 57 is pressed to the central side by a spring 57*a*, the hemispheric end 57*b* is contact with the check valve sheet 57*c* and it blocks a passage for supplying fuel from the fuel pipe 9 to the fuel rail 10.

In the meantime, the relief valve 59 is pressed to the central side by a spring 59*a*, the hemispheric end 59*b* is contact with a relief valve sheet 59*c* and it blocks a passage for returning fuel from the fuel rail 10 to the fuel pipe 9.

Figure 7:
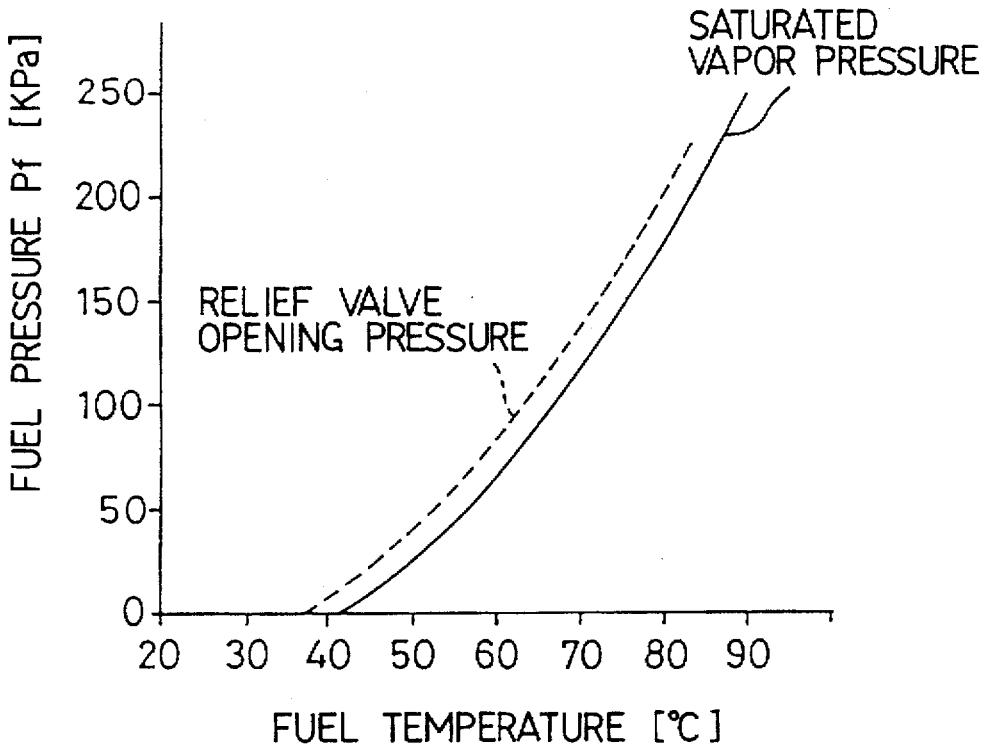
FIG. 7 is a graph showing the relationship between fuel temperature and fuel pressure.
Figure 8A:
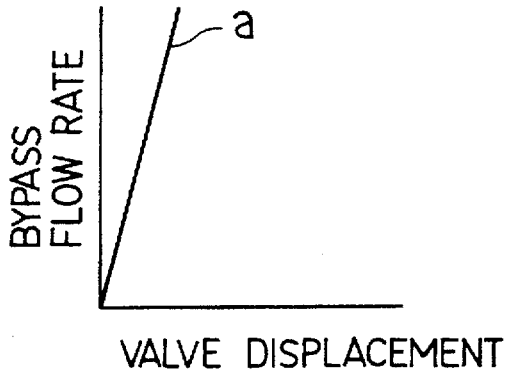
FIGS. 8A, 8B and 8C are graphs showing the relationship between the operation of a bypass flow regulating valve and flow rate.
Figure 8B:
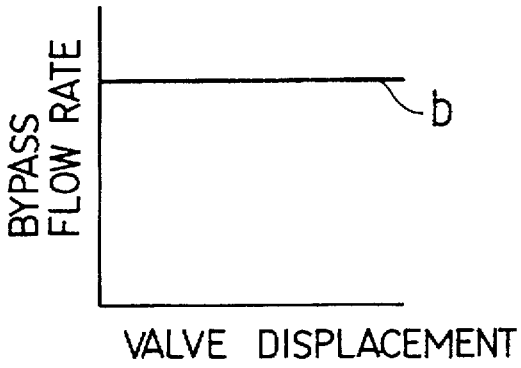
Figure 8C:
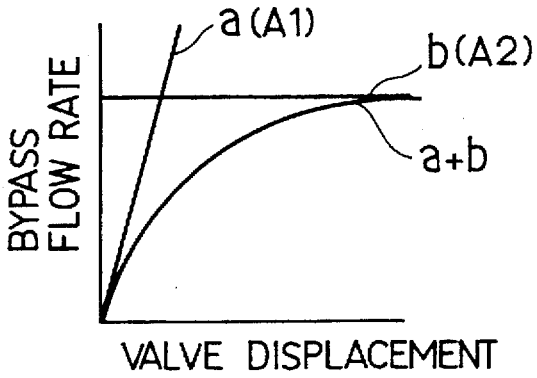

The above-described springs 57*a* and 59*a* are formed by a shape memory alloy the form (that is, pressure) of which varies depending upon temperature. Of these, the pressure of the spring 57*a* for the check valve 57 is set to such pressure that opens a passage smoothly when the fuel pump is driven and the fuel pressure reaches predetermined pressure for opening the valve (that is, the lower limit value of fuel pressure Pf). The pressure of the spring 59*a* for the relief valve 59 is set so that the relief valve is opened by pressure for opening the valve which is a little higher than saturated vapor pressure (that is, the upper limit value of fuel pressure Pf) as shown in FIG. 7.

Figure 21:
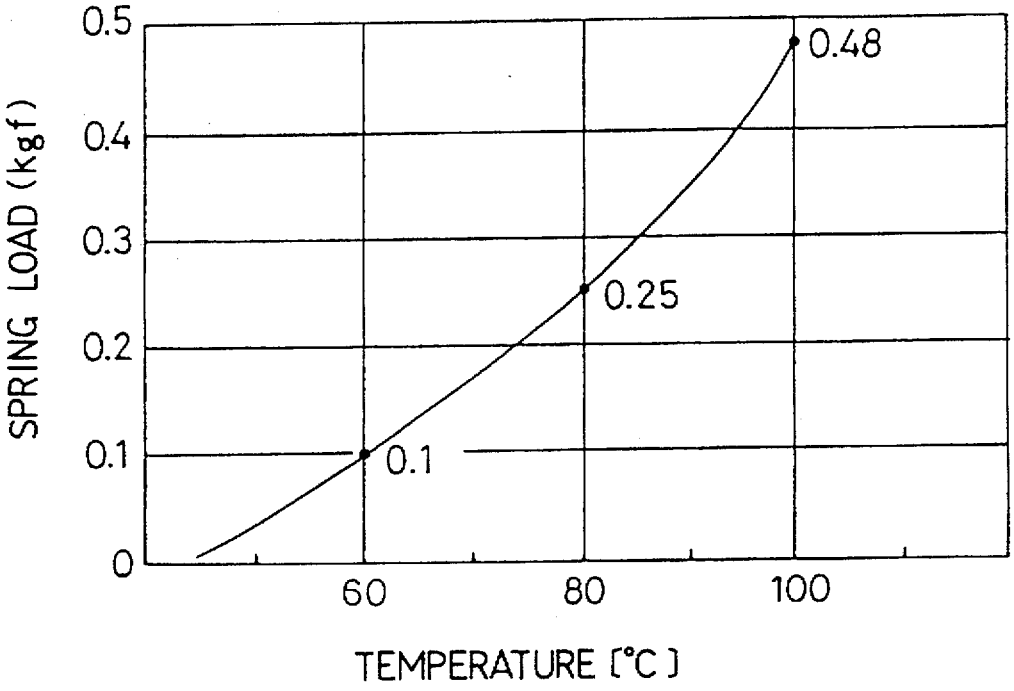
FIG. 21 is a graph showing the characteristics of a spring in the eighth embodiment.

It is because the pressure for opening the relief valve 59 varies depending upon temperature as saturated vapor pressure varies depending upon temperature that a shape memory alloy is used for the spring 59*a*. If a spring according to the relationship between temperature and a load by a spring shown in FIG. 21 is used as this spring 59*a*, such a spring is suitable because the pressure of such a spring can be readily set to the pressure for opening the relief valve which is a little higher than saturated vapor pressure.

Next, the operation of this bidirectional valve 16 will be described.

First, in the bidirectional valve 16, when the fuel pump 3 is operated, fuel is supplied from the central chamber 51 to a passage 51*a* in the direction shown by an arrow in a full line, the check valve 57 is opened by the pressure and fuel is supplied from the left chamber 53 to the fuel rail 10.

At this time, if fuel pressure Pf is lower than the pressure for opening the relief valve 59 which is set so that the pressure is a little higher than saturated vapor pressure, the relief valve 50 is not opened. As the relief valve is opened when fuel pressure Pf is increased and reaches the pressure for opening the relief valve 59, fuel on the side of the fuel rail 10 is fed into the central chamber 51 through the passages 53*a* and 53*b* and the right chamber 55. Therefore, the fuel pressure Pf inside the fuel rail 10 is kept equal to or lower than the pressure for opening the relief valve 59.

When the fuel pump 3 is stopped, the fuel pressure Pf inside the fuel rail 10 is kept low and the relief valve 59 is closed. Even if the temperature of an internal combustion engine is raised and the fuel pressure inside the fuel rail 10 is increased from the above-described state, the relief valve 59 is kept closed while the pressure does not exceed saturated vapor pressure. Further, as the relief valve 59 is opened to release pressure when the fuel pressure inside the fuel rail 10 is increased, exceeds saturated vapor pressure, is further increased even if vapor is changed to liquid and exceeds the pressure for opening the relief valve, the fuel pressure Pf is kept equal to or lower than the pressure for opening the relief valve.

As described above, in this embodiment, when the fuel pump 3 is operated, fuel under predetermined fuel pressure Pf is supplied to the fuel rail 10 through the check valve 57 and when fuel pressure Pf reaches a predetermined upper limit value which is a little higher than saturated vapor pressure according to the temperature of fuel, the relief valve 59 is opened to reduce fuel pressure Pf. Therefore, fuel pressure Pf can be kept the pressure which is a little higher than saturated vapor pressure in the range of predetermined temperature of fuel.

Therefore, bubbles can be prevented from being generated and leakage of fuel from a fuel injection valve 11 caused when fuel pressure Pf is too high can be effectively prevented.

(Ninth Embodiment)

Next, a ninth embodiment will be described.

In this embodiment, the description of the same hardware as in the first embodiment is omitted or simplified, however, the same drawings are also used in this embodiment.

Figure 22A:
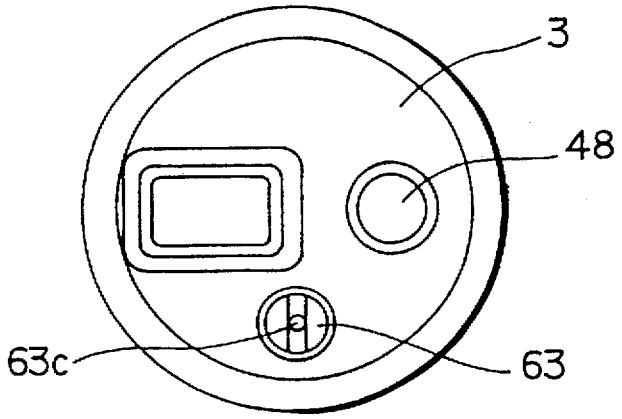
FIG. 22A is a plan showing a fuel pump in a ninth embodiment and FIG. 22B is an explanatory drawing showing a bypass flow rate regulating valve thereof.
Figure 22B:
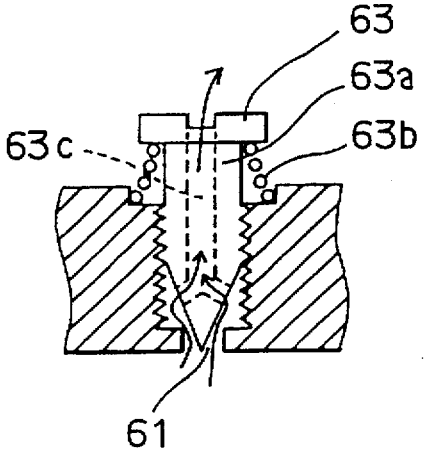

This embodiment is different from the first embodiment in which a spring 48*b* for regulating the pressure for opening a valve is changed to change the characteristics of a fuel pump 3 and is characterized in that bypass flow rate is regulated using a bypass flow rate regulating valve 63 which can change the area of a bypass passage 61 as shown in FIG. 22B.

This bypass flow rate regulating valve 63 is provided in the passage 61 for connecting a passage 3*a* shown in FIG. 10 and the outside of the fuel pump 3. The bypass flow rate regulating valve 63 is constituted by a screw 63*a* with the conic end screwed in the passage 61 and a spring 63*b* for pressing the screw upward so that the screw 63*a* is not loose and further, a passage 63*c* the end of which branches is provided in the center in the direction of the axis of the screw 63*a*. The passage 61 on the side of the fuel pump (downward in the drawing) is narrowed so that the passage 61 can be blocked by the end of the screw 63*a*.

Therefore, the bypass flow rate regulating valve 63 is constituted so that bypass flow rate is reduced by press-fitting the screw 63*a*, the passage 61 is blocked when the screw is screwed up to the end and bypass flow rate is increased when the screw is turned in the reverse direction.

Figure 6:
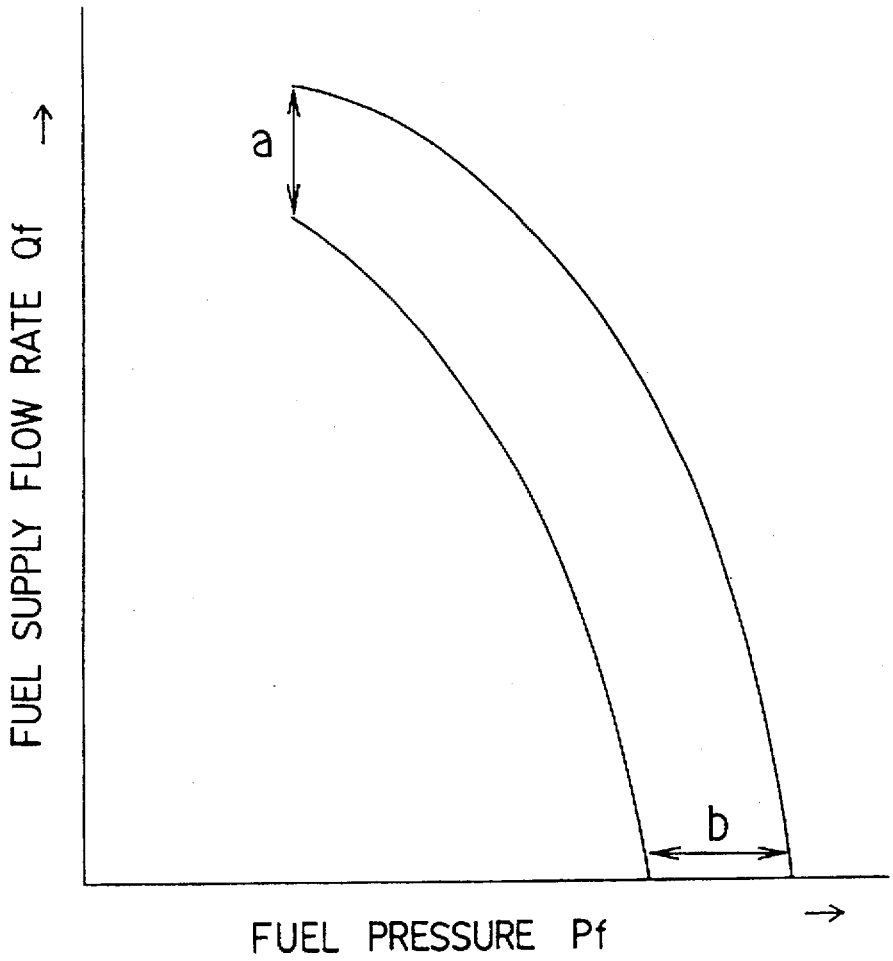
FIG. 6 is a graph showing the relationship between fuel pressure and fuel supply flow rate.

Therefore, as shown by a in FIG. 6, the relationship between fuel supply flow rate and fuel pressure can be readily adjusted by turning this bypass flow rate regulating valve 63.

An orifice not shown may be provided in this passage 61 in place of the above-described constitution. In this case, the passage 61 is replaced with a passage 61 with an orifice different in the bore diameter to change the characteristics of the fuel pump 3.

(Tenth Embodiment)

Next, a tenth embodiment will be described.

In this embodiment, the description of the same hardware as in the first embodiment is omitted or simplified, however, the same drawings are also used in this embodiment.

A bypass flow rate regulating valve used in this embodiment is a little different in the form from that in the ninth embodiment.

Figure 23:
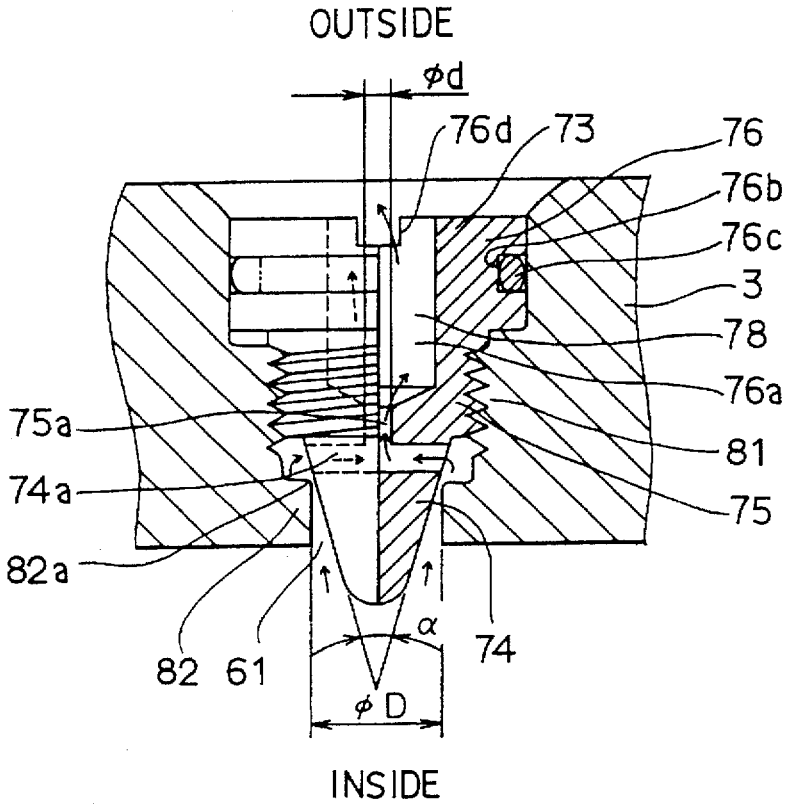
FIG. 23 is an explanatory drawing showing a bypass flow rate regulating valve in a tenth embodiment.

As shown in FIG. 23, a bypass flow rate regulating valve 73 in this embodiment is attached to a communicating passage 61 which forms a passage connecting the inner side and the outer side of a fuel pump 3.

This bypass flow rate regulating valve 73 is constituted by a conic portion 74 tapered by an angle for opening or closing the passage, a screw 75 for moving the tapered portion 74 in the axial direction by screwing and a flange 76 with a large diameter for sealing fuel.

A communicating hole 74*a* which communicates left and right is provided in the upper part of the above-described tapered portion 74, an orifice 75*a* with a bore diameter d which communicates with the passage 74*a* is provided in the center of the axis of the screw 75, a communicating hole 76*a* with a large bore diameter which communicates with the orifice 75*a* is provided in the center of the axis of the flange 76 and hereby, a passage 78 the end of which branches left and right horizontally from the center of the axis of the bypass flow rate regulating valve 73 is formed.

A circular groove 76*b* is formed on the peripheral surface of the flange 76 and a packing 76*c* for sealing is arranged in this groove 76*b*. Further, a groove 76d for screwing the bypass flow rate regulating valve 73 is provided in the center of the axis of the flange 76 on the side of the outside.

In the meantime, a screw 81 is formed in correspondence with the shape of the bypass flow rate regulating valve 73 on the side of the fuel pump 3 to which the bypass flow rate regulating valve 73 is attached and particularly on the inner side thereof, a circular portion 82 protruded on the inner side with a bore diameter D is formed in correspondence with the superficial shape of the above tapered portion 74. Therefore, the plane in the shape of a truncated cone which vertically extends from the upper end of the circular portion 82 on the inner side to the surface of the tapered portion 74 is equivalent to the section of the adjustable passage.

Therefore, the bypass flow rate regulating valve 73 is constituted so that the section of the adjustable passage is changed by screwing itself to reduce bypass flow rate, its tapered portion 74 is contact with the circular portion 82 and the communicating passage 61 is blocked when the valve is screwed up to the end and in the meantime, bypass flow rate is increased when the valve is turned in the reverse direction.

Next, a method of adjustment using this bypass flow rate regulating valve 73 will be described referring to FIG. 24.

Figure 24:
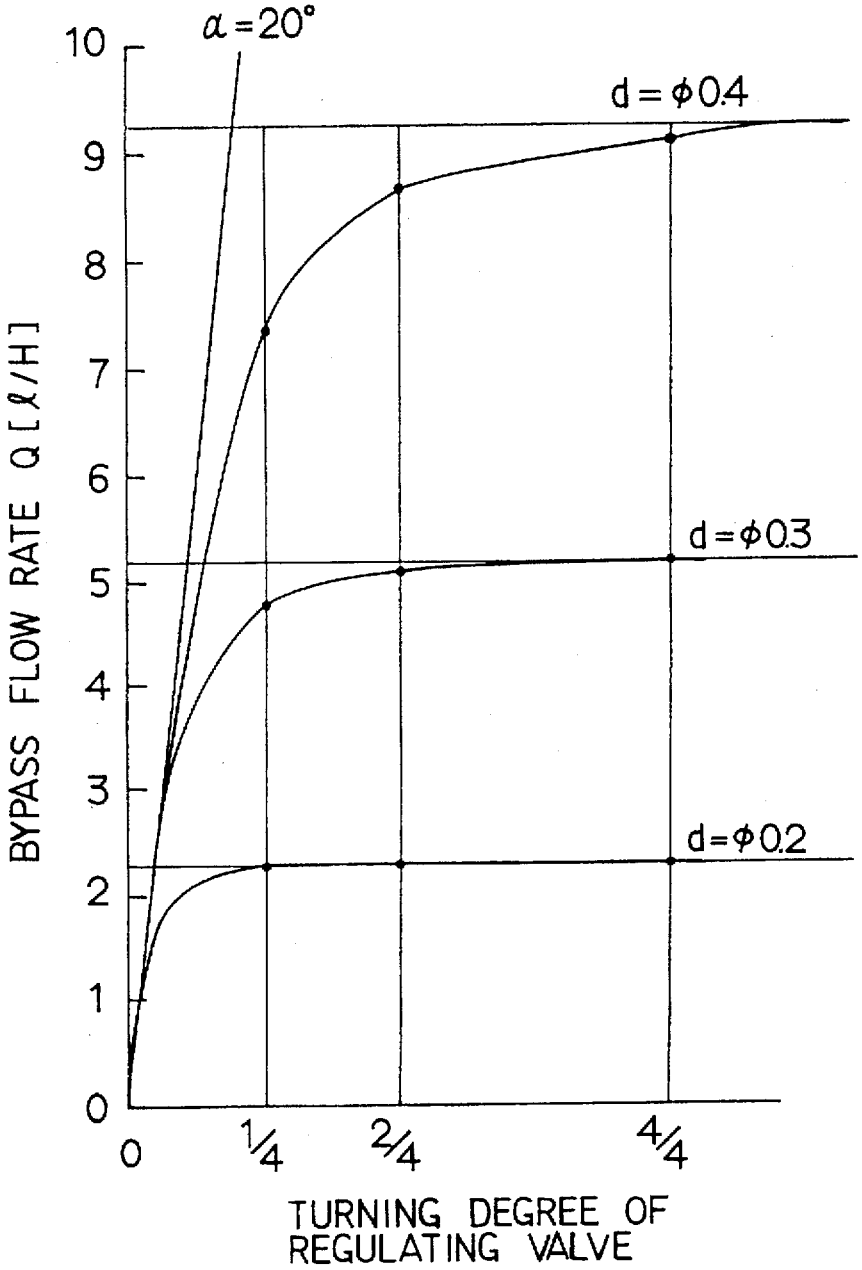
FIG. 24 is a graph showing the change of bypass flow rate corresponding to the operation of the bypass flow rate regulating valve in the tenth embodiment.

The y-axis in FIG. 24 shows bypass flow rate liter per hour (1/H), the x-axis shows the degree of the turning of the bypass flow rate regulating valve 73 and shows the change of bypass flow rate Q according to the turning of the bypass flow rate regulating valve 73 if $\alpha=20°$ and the diameter d of an orifice is changed.

As shown in FIG. 24, in this embodiment, as bypass flow rate Q is not rapidly changed even if the bypass flow rate regulating valve 73 is turned, the fine adjustment of bypass flow rate can be suitably performed. The change of bypass flow rate Q can be arbitrarily set in the range in which turning is particularly small by changing the angle of the tapered portion 74. Further, it can be arbitrarily set in the vicinity of which bypass flow rate Q adjustment is performed by changing the diameter d of the orifice and more precise adjustment is enabled.

(Eleventh Embodiment)

Next, an eleventh embodiment will be described.

In this embodiment, the description of the same hardware as in the first embodiment is omitted or simplified, however, the same drawings are also used in this embodiment.

This embodiment is different from the above-described each embodiment and relates to a fuel supply system, in the concrete, a method of adjusting a fuel pump 3. This embodiment will be described in the order of adjusting processes below.

a) Rotating speed adjusting process

First, a pressure gauge for measuring discharge pressure and a flow meter for measuring fuel supply flow rate are arranged in a passage on the discharge side of the fuel pump 3 and a measurement circuit for detecting the rotating speed of the fuel pump 3 (that is, dc electric motor) based upon the change of supply current to the fuel pump 3 (that is, the dc electric motor for driving the fuel pump 3) is provided.

In this state, a supply current value is adjusted and the rotating speed of the fuel pump 3 is set to the reference rotating speed of the fuel pump.

b) Pressure adjusting process

Next, the fuel supply pressure (discharge pressure) of the fuel pump 3 the rotating speed of which is adjusted in the above rotating speed adjusting process is adjusted to the reference fuel supply pressure by adjusting the pressure for opening the check valve 48*a* described in the first embodiment and the strength of a magnet in the dc electric motor.

c) Flow rate adjusting process

Next, the fuel supply flow rate (discharge flow rate) of the fuel pump 3 the fuel supply pressure of which is adjusted in the above pressure adjusting process is adjusted to the reference fuel supply flow rate by turning the bypass flow rate regulating valve 73 described in the tenth embodiment.

Figure 25:
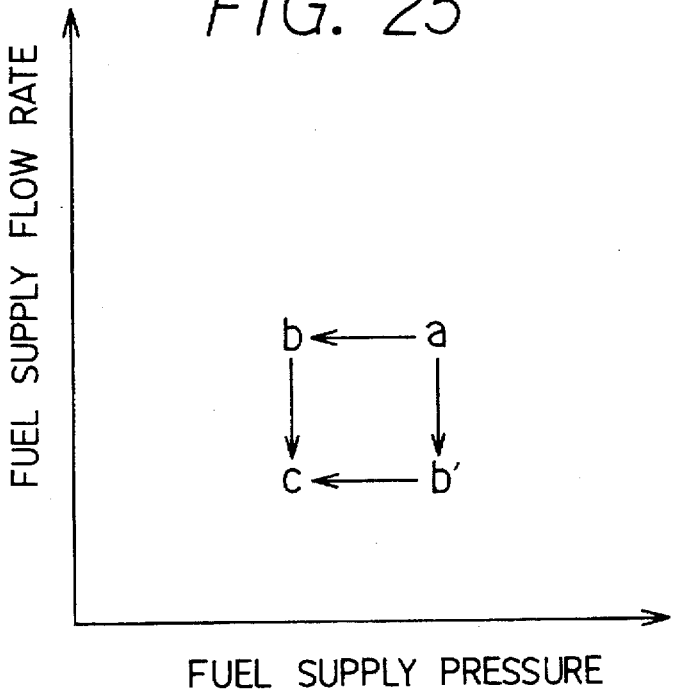
FIG. 25 is an explanatory drawing showing an adjustment method in eleventh and twelfth embodiments.

As shown in FIG. 25, by the above-described methods of adjustment, a position a arranged in the rotating speed adjusting process is moved to a position b in the pressure adjusting process and further moved to an appropriate position c in the flow rate adjusting process.

Hereby, the characteristics of the fuel pump 3 and the dispersion of circuits for driving the fuel pump 3 can be precisely and readily adjusted.

(Twelfth Embodiment)

Next, a twelfth embodiment will be described.

In this embodiment, the description of the same hardware as in the first embodiment is omitted or simplified, however, the same drawings are also used in this embodiment.

This embodiment relates to a fuel supply system, in the concrete, a method of adjusting a fuel pump 3 as the eleventh embodiment. This embodiment will be described in the order of adjusting processes.

a) Rotating speed adjusting process

First, a pressure gauge for measuring discharge pressure and a flow meter for measuring fuel supply flow rate are arranged in a passage on the side of discharge of the fuel pump 3 and a measurement circuit for detecting the rotating speed of the fuel pump 3 based upon the change of supply current to the fuel pump 3 is provided.

In this state, a supply current value is adjusted and the rotating speed of the fuel pump 3 is set to the reference rotating speed of the fuel pump.

b) Flow rate adjusting process

Next, the fuel supply flow rate of the fuel pump 3 the rotating speed of which is adjusted in the above rotating speed adjusting process is adjusted to the reference fuel supply flow rate by turning the bypass flow rate regulating valve 73 described in the tenth embodiment.

c) Pressure adjusting process

Next, the fuel supply pressure of the fuel pump 3 the fuel supply flow rate of which is adjusted in the above flow rate adjusting process is adjusted to the reference fuel supply pressure by adjusting the pressure for opening the check valve 48*a* described in the first embodiment and the strength of a magnet in the dc electric motor.

As shown in FIG. 25, by the above-described methods of adjustment, a position a arranged in the rotating speed adjusting process is moved to a position b in the flow rate adjusting process and further moved to an appropriate position c in the pressure adjusting process.

Hereby, the characteristics of the fuel pump 3 and the dispersion of circuits for driving the fuel pump 3 can be precisely and readily adjusted as in the eleventh embodiment.

(Thirteenth Embodiment)

Next, a thirteenth embodiment will be described.

In this embodiment, the description of the same hardware as in the first embodiment is omitted or simplified, however, the same drawings are also used in this embodiment.

In this embodiment, the fuel supply system which is adjusted according to the methods of adjustment described in the tenth embodiment or the eleventh embodiment is adjusted again in actual operation. Methods of adjustment equivalent to this embodiment will be described referring to a flowchart in FIG. 26.

Figure 26:
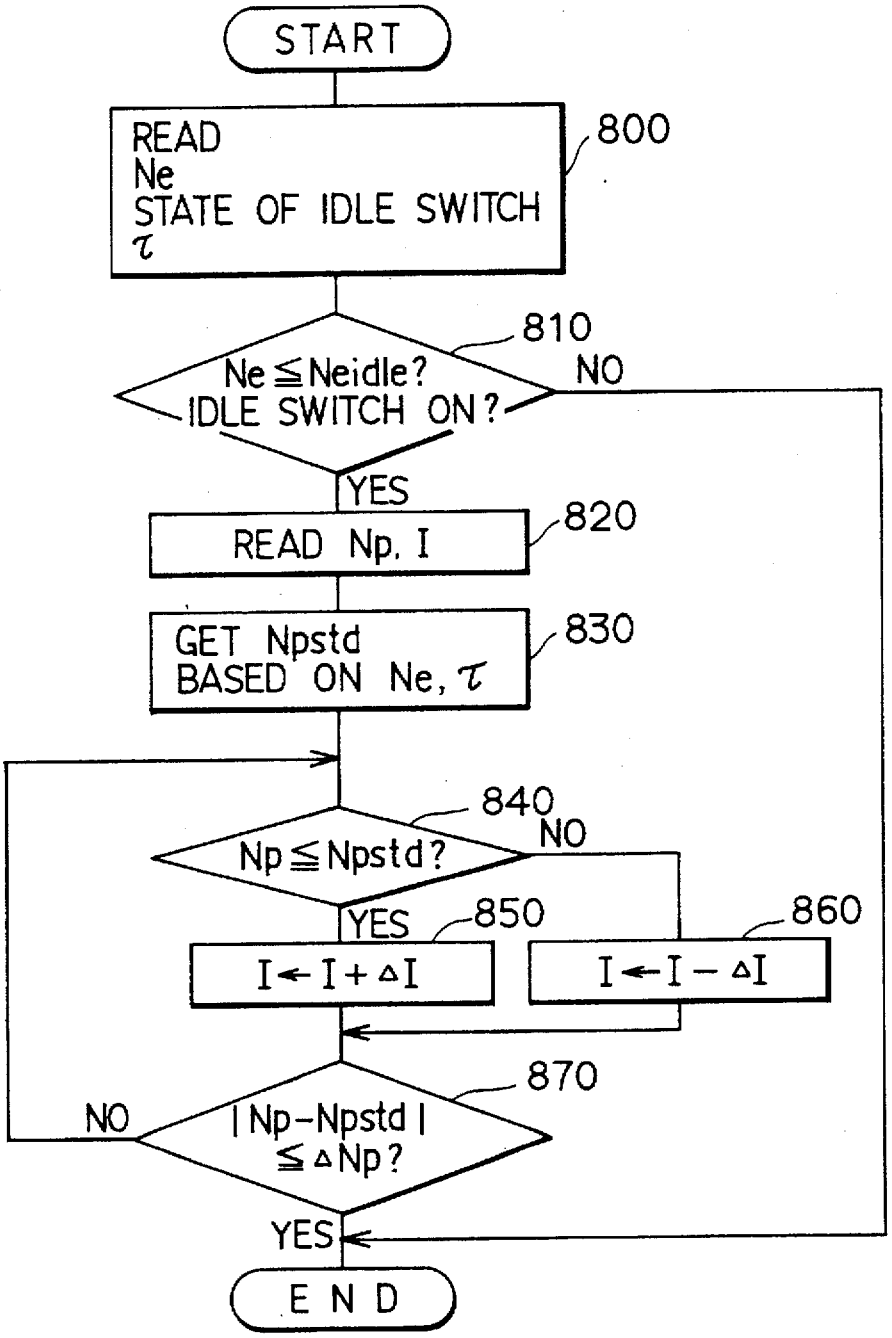
FIG. 26 is a flowchart showing an adjustment method in a thirteenth embodiment.

In a step 800 in FIG. 26, the engine speed Ne, the state of an idle switch and the pulse width $\tau$ of a fuel injection valve are read from a sensor and others.

In the next step 810, it is judged whether the engine speed Ne is smaller than a predetermined value (idle engine speed) Ne idle or not and whether an idle switch is turned on or not. If affirmative judgement is made in this step, the processing proceeds to a step 820 and in the meantime, if negative judgement is made, this processing is once terminated.

In the step 820, the actual rotating speed Np of the fuel pump and current actually supplied to the fuel pump are read from a measurement circuit and others.

In the next step 830, the target rotating speed Npstd of the fuel pump is obtained based upon the engine speed Ne and the pulse width $\tau$ of a fuel injection valve.

In the next step 840, it is judged whether the actual rotating speed Np of the fuel pump is smaller than the target value Npstd or not. If affirmative judgement is made in this step, the processing proceeds to a step 850 and in the meantime, if negative judgement is made, the processing proceeds to a step 860.

In the step 850, as the actual rotating speed Np of the fuel pump is smaller than the target value Npstd, current supplied to the fuel pump is increased by a predetermined value 1 to increase the rotating speed Np of the fuel pump and the processing proceeds to a step 870.

In the meantime, in the step 860, as the actual rotating speed Np of the fuel pump is more than the target value Npstd, current 1 supplied to the fuel pump is reduced by a predetermined value $\Delta I$ to reduce the rotating speed Np of the fuel pump and the processing proceeds to a step 870.

In the step 870, the deviation (an absolute value) of the actual rotating speed Np of the fuel pump from the target value Npstd is obtained and it is judged whether this deviation is smaller than a predetermined value Np or not. If affirmative judgement is made in this step, this processing is once terminated because it is judged that the actual rotating speed Np of the fuel pump is close enough to the target value Npstd. In the meantime, if negative judgement is made, control is returned to the above step 840 to adjust the current supplied to the fuel pump again.

As described above, in this embodiment, as current 1 supplied to the fuel pump is adjusted so that the actual rotating speed Np of the fuel pump is close to the target value Npstd, the characteristics of the fuel pump 3 and the dispersion of circuits caused by change in elapsed time can be suitably adjusted.

(Fourteenth Embodiment)

FIGS. 28 to 34 show a fourteenth embodiment.

Figure 28:
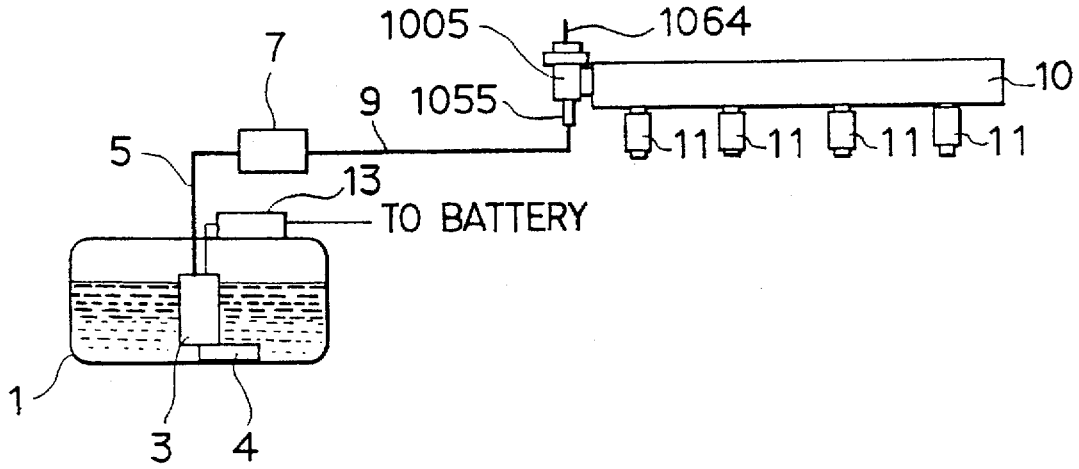
FIG. 28 is a block diagram showing a fuel supply system for an internal combustion engine equivalent to a fourteenth embodiment according to the present invention.

As shown in FIG. 28, a fuel supply system is constituted by a fuel pump arranged in a fuel tank 1, a high pressure fuel filter 7 connected to the discharge side of this fuel pump 3 via a fuel pipe 5, a pressure control valve 1005 connected to the exit side of this high pressure fuel filter 7 via a fuel pipe 9, a fuel rail 10 located on the downstream side of this pressure control valve 1005 into which fuel to which pressure controlled by the pressure control valve 1005 is applied is fed, a fuel injection valve 11 arranged on this fuel rail 10 by the number of cylinders for injecting and supplying fuel toward the intake port of an internal combustion engine not shown and a constant current type control circuit 13 for controlling power supplied from a battery not shown to the fuel pump 3 by controlling current.

A low pressure fuel filter 4 for removing a foreign matter when fuel is pumped is attached to the fuel pump 3 arranged in the fuel tank 1 and fuel pumped by this fuel pump 3 is fed to the high pressure fuel filter 7 via the fuel pipe 5. A minute foreign matter and water included in fuel are removed by the high pressure fuel filter 7 and filtered fuel is fed to the pressure control valve 1005 via the fuel pipe 9.

The pressure control valve 1005 controls pressure so that there is a predetermined difference between the pressure in an intake manifold described later and not shown and the pressure in the fuel rail 10. High pressure fuel supplied to the fuel rail 10 via this pressure control valve 1005 is injected toward the intake port of the internal combustion engine not shown from the fuel injection valve 11.

As the fuel supply system shown in FIG. 28 is a returnless fuel supply system, a return pipe which returns from the fuel rail 10 to the fuel tank 1 is not provided. Therefore, the motor of the fuel pump 3 is controlled by the constant current type control circuit 13 so that the fuel pressure inside the fuel rail 10 for the amount of fuel discharged from the fuel rail 10 is close to the characteristic d shown in FIG. 34.

Hereby, a relief valve which is heretofore attached to the fuel rail 10 and used to control so that fuel pressure does not exceed predetermined pressure can be disused. As fuel pressure inside the fuel rail is controlled by the pressure control valve 5 so that it is fixed even if the discharged amount is further increased, the characteristic d shown in FIG. 34 can be obtained.

Next, the constitution of the pressure control valve 1005 will be described referring to FIGS. 29 to 32C.

Figure 29:
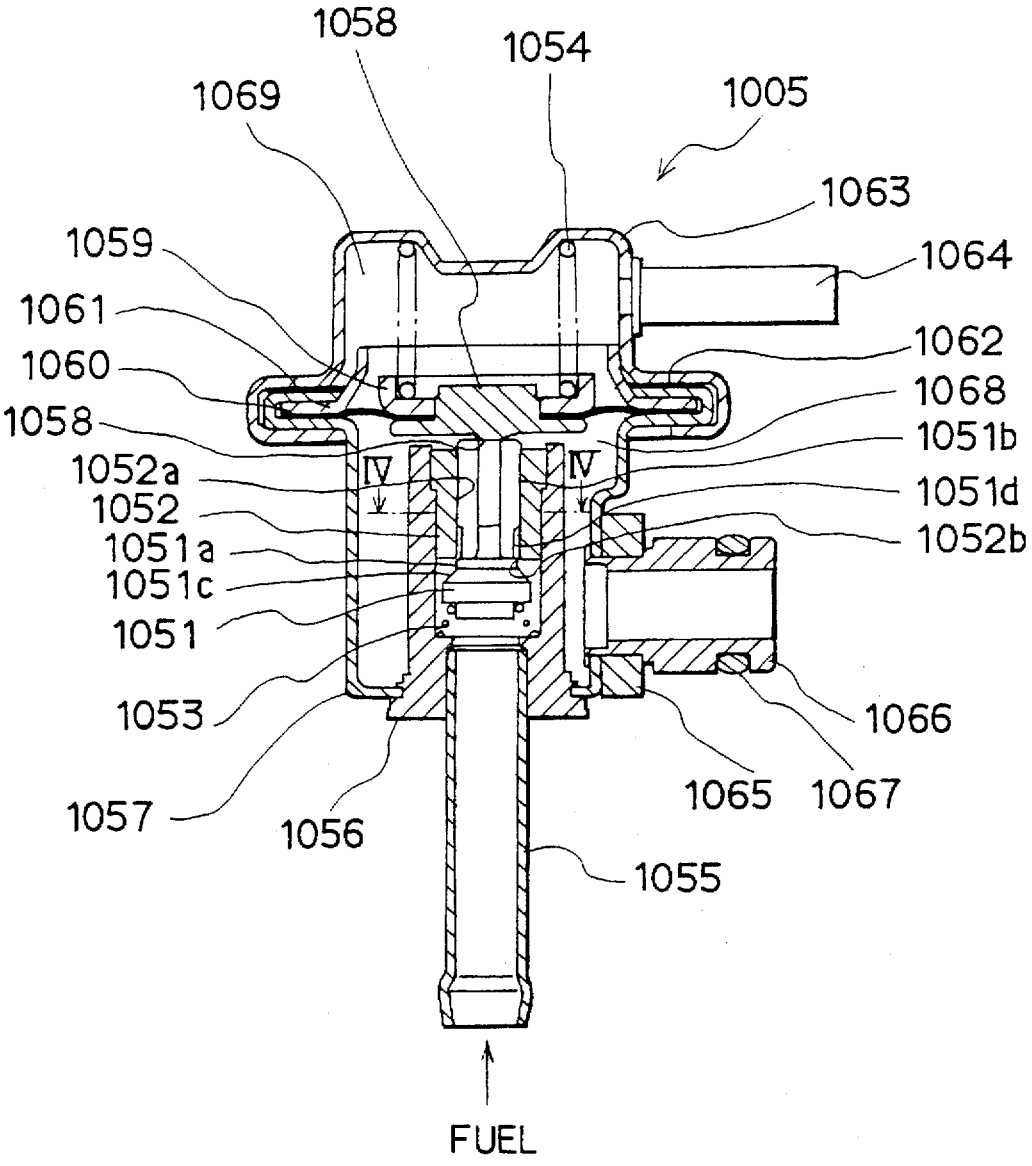
FIG. 29 is a sectional view showing a pressure control valve in a fuel supply system for an internal combustion engine equivalent to the fourteenth embodiment.

As shown in FIG. 29, the pressure control valve 1005 is constituted so that a diaphragm 1060 is wrapped and fixed together with a pressure plate 1061 and a gasket 1062 on the boundary between the body 1057 and a cover 1063. The center of the diaphragm 1060 is held between/by a valve presser 1058 and a lower seat 1059, and the diaphragm 1060, the valve presser 1058 and the lower seat 1059 are reciprocated integrally. The lower seat 1059 is pressed in the direction of a diaphragm lower chamber 1068 as a second pressure chamber described later by a compression coil spring 1054 located between the inner wall of the cover 1063 and the lower seat 1059.

Controlled pressure can be varied depending upon the temperature of fuel as described later by forming this compression coil spring 1054 by a shape memory alloy. A diaphragm lower chamber 1068 as a first pressure chamber in which the compression coil spring 1054 is housed is connected to the intake manifold not shown by a pipe 1064 and pressure inside this diaphragm lower chamber 1068 is set to negative pressure in the intake manifold.

In the meantime, a pipe 1055 connected to the above-described fuel pipe 13 is attached to the body 1057 via a connector 1056. A connector 1066 which can be attached to the fuel rail 10 is also attached to the body 1057 by a flange 1065. O ring 1067 for connecting the pressure control valve 1005 and the fuel rail 10 closely is attached on the periphery of the end of this connector 1066. In the diaphragm lower chamber 1068 formed in the body 1057, the cylindrical connector 1056 provided with the pipe 1055 at one end is housed. In this connector 1056, a cylindrical valve 1052 and a valve member 1051 provided with an inner guide 1051*b* which can be slid in this valve 1052 are housed. This valve member 1051 is pressed by a compression coil spring 1053 housed in the valve 1052 in the direction in which the valve is opened.

The valve member 1051 is provided with a contact portion 1051*c* tapered toward the inner guide 1051*b* and a cylindrical spool 1051*a* between this contact portion 1051*c* and the inner guide 1051*b*. The outside diameter of this spool 1051*a* is formed so that it is a little smaller than the bore diameter of the above valve 1052 and a circular groove 1050 as a passage is formed between an outer guide 1052*a* which is the inner wall of the valve 1052 as shown in FIG. 5 and the spool 1051*a*. The area of a passage can be kept a predetermined value for a predetermined period immediately after the valve is opened as described later by the length h of the spool 1051*a* in the axial direction.

Figure 31:
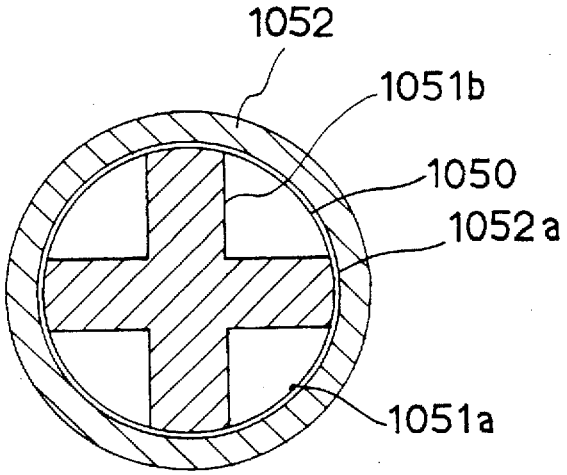
FIG. 31 is a sectional view along a line IV—IV showing a valve member 1051 and the body of a valve 1052 shown in FIG. 2.

As shown in FIG. 31, the inner guide 1051*b* has a cross-shaped section in the direction of the diameter and a notch 1051*d* is formed in the vicinity of a portion connected to the spool 1051*a* as shown in FIG. 29 and FIGS. 32A–32C. When fuel is moved by a predetermined distance equivalent to the length h of the spool 1051*a* in the axial direction immediately after the valve is opened, the area of the passage can be rapidly increased owing to this notch 1051*d*.

Figure 30:
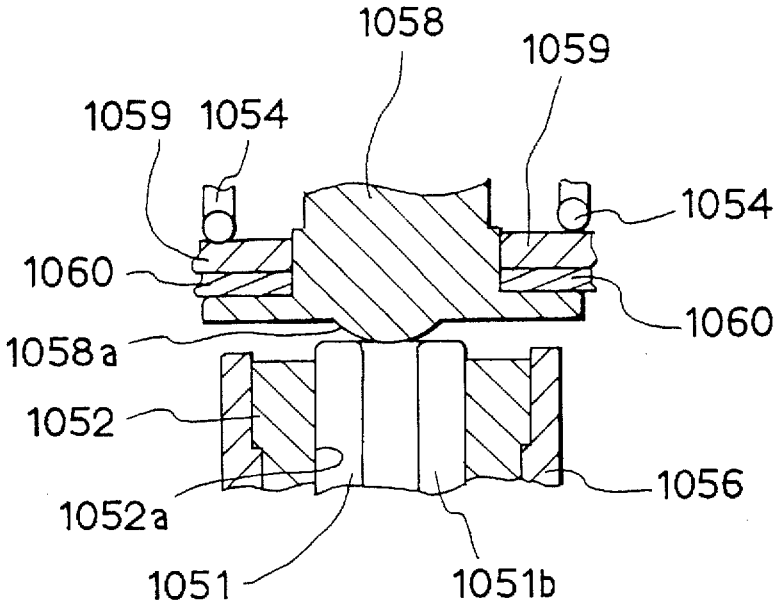
FIG. 30 is a schematic sectional view showing a state in which the valve member of a pressure control valve and a valve presser are contact in the fourteenth embodiment.

As shown in FIG. 30, a spherical portion 1058*a* as a convex spherical portion with a convex sphere protruded in the direction of the valve member 1051 is formed in the center of the valve presser 1058 which is contact with the upper end of the valve member 1051. As the spherical portion 1058*a* is contact with approximately the center of the upper end of the valve member 1051 even if the valve presser 1058 is diagonally contact with the valve member 1051 because, for example the diaphragm 1060 is tilted, the axis of the valve member 1051 can be prevented from being diagonally pressed. Hereby, as the valve member 1051 can be prevented from being slid with it tilted to the axis of the valve 1052, there is effect that abrasion between the inner wall of the valve 1052 and the side wall of the valve member 1051 can be prevented.

Next, the operation of the fuel supply system for the internal combustion engine will be described referring to FIGS. 28 and 29 and further, the operation of the pressure control valve 5 will be described referring to FIGS. 29, 32A, 32B, 32C and 33.

As shown in FIGS. 28 and 29, after fuel in the fuel tank is pumped and pressed by the fuel pump 3, it flows into the pipe 1055 of the pressure control valve 1005 through the low pressure fuel filter 4, the fuel pipe 5, the high pressure fuel filter 7 and the fuel pipe 9. Fuel which flows into the connector 1056 through the pipe 1055 flows into the notch 1051*d* of the valve member 1051 through a passage formed between the contact portion 1051*c* and a valve seat 1052*b* when the contact portion 1051*c* of the valve member 1051 is separated from the valve seat 1052*b* of the valve 1052 as shown in FIG. 29. Fuel which flows into this notch 1051*d* flows into the diaphragm lower chamber 1068 through the inner guide 1051*b* of the valve member 1051, is supplied to the fuel rail 10 through the connector 1066 and is injected from the fuel injection valve 11 toward the intake port of the internal combustion engine not shown. As described above, fuel pumped from the fuel tank is injected from the fuel injection valve 11. The pressure control valve 1005 is closed when the difference between the pressure in the diaphragm upper chamber 1069 and the pressure in the diaphragm lower chamber 1068 is larger than a predetermined value and the contact portion 1051*c* of the valve member 1051 is contact with the valve seat 1052*b* of the valve 1052 as described in detail below and when pressure is reduced up to the target fuel pressure value and the contact portion 1051*c* of the valve member 1051 is separated from the valve seat 1052*b* of the valve 1052, the pressure control valve is opened. Hereby, the fuel pressure in the fuel rail 10 located on the downstream side of the pressure control valve 1005 is controlled so that it is fixed.

As shown in FIG. 29, the position of the valve presser 1058 is displaced by balance among the pressure in the diaphragm upper chamber 1069, that is, intake manifold pressure, fuel pressure applied to the diaphragm lower chamber 1068, that is, the fuel pressure in the fuel rail 10, the pressure of the compression coil spring 1054 in the direction in which the valve is opened housed in the diaphragm 1069 and the pressure of the compression coil spring 1053 in the direction in which the valve is closed. The valve member 1051 which is contact with the valve presser 1058 by the pressure of the compression coil spring 1053 is moved in the direction in which the valve is closed or opened by the displacement of the valve presser 1058.

When high pressure fuel in the diaphragm lower chamber 1068 is discharged into the fuel rail 10 connected to the connector 1066, the fuel pressure in the diaphragm lower chamber 1068 is reduced. When the sum of the inner pressure of the diaphragm upper cheer 1069 and the pressure by the compression coil spring 1054 is larger than the sum of the fuel pressure of the diaphragm lower chamber 1058 and the pressure by the compression coil spring 1053 by reduction of this fuel pressure, the valve presser 1058 is displaced in the direction in which the valve is opened, the valve member 1051 is pressed by the valve presser 1058 and it is opened.

Figures 32A, 32B, 32C:
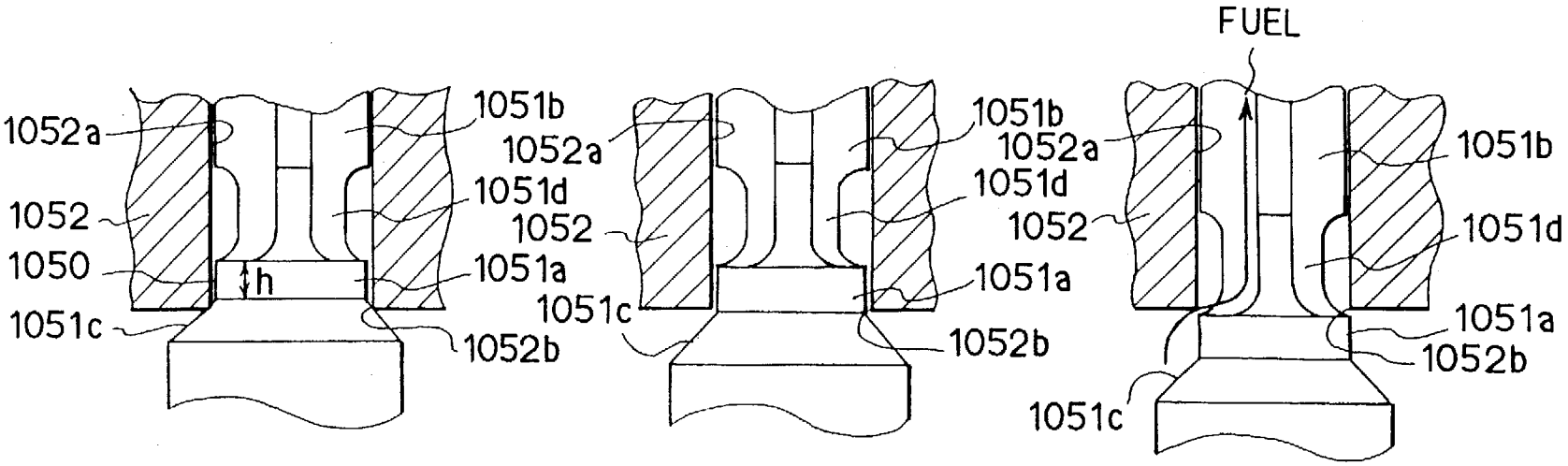
FIGS. 32A, 32B and 32C are explanatory drawings showing each state from opening of a pressure control valve to closing in the fourteenth embodiment.

At this time, as shown in FIG. 32A, the contact portion 1051*c* of the valve member 1051 is contact with the valve seat 1052*b* of the valve 1052 when the valve member 1051 is closed. Therefore, in this state, as shown by a in FIG. 6, the valve is not lifted.

When the valve member 1051 is moved in the direction in which the valve is opened because of displacement in the above direction of the valve presser 1058, the contact portion 1051*c* is separated from the valve seat 1052*b* as shown in FIG. 32B. The area of the passage at this time is equivalent to the area of the section in the diameter of the circular groove 1050 formed on the periphery of the spool 1051*a* of the valve member 1051 as described above and is shown by an interval b in FIG. 33. That is, as the area of the passage is kept fixed keeping a predetermined minute value while by a predetermier 1051 is moved by a predetermined distance equivalent to the length h of the spool 1051*a* in the axial direction immediately after the valve member 1051 is shifted from a state in which it is closed to a state in which it is opened, the area of the passage is kept a predetermined minute value in an interval b in FIG. 6.

Figure 33:
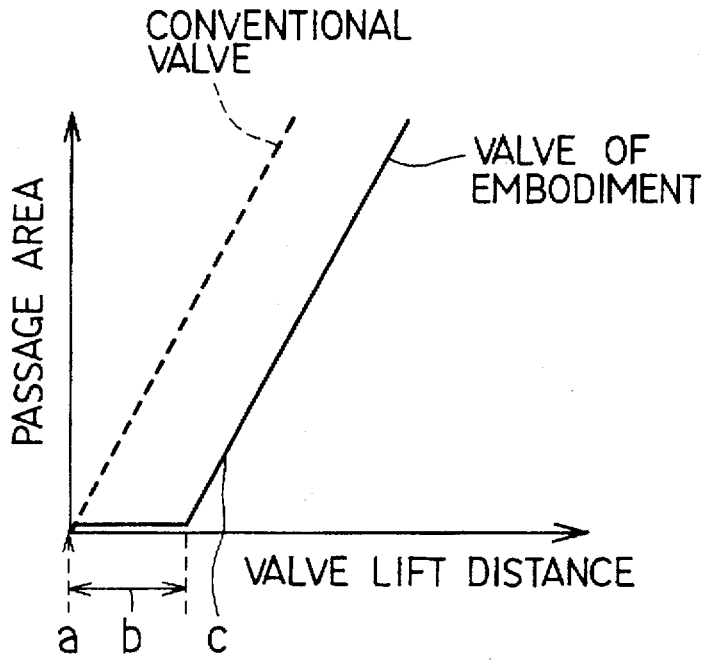
FIG. 33 shows characteristics showing the area of a passage corresponding to the quantity in which the valve member of a pressure control valve is lifted.

Further, when the valve member 1051 is moved in the direction in which the valve is opened by a predetermined distance equivalent to the length h of the spool 1051*a* in the axial direction, the area of the passage is gradually increased as c shown in FIG. 33 because of the notch 1051*d* formed up the spool 1051*a* as shown in FIG. 32C. Fuel flows into the valve 1052 as shown by an arrow in FIG. 32C and fuel flows into the diaphragm lower chamber 1068 through between the valve 1052 and the valve presser 1058 by this increase of the area of the passage. Hereby, as the fuel pressure in the diaphragm lower chamber 1068 is gradually increased, the sum of the fuel pressure in the diaphragm lower chamber 1068 and the pressure in the direction in which the valve is closed by the compression coil spring 1053 is larger than the sum of the inner pressure in the diaphragm upper chamber 1069 and the pressure in the direction in which the valve is closed by the compression coil spring 1054. Then, the valve presser 1058 is displaced in the direction in which the valve is closed against the pressure by the compression coil spring 1054. As the valve member pressed by the compression coil spring 1053 in the direction in which the valve is closed can be moved in the above direction by this movement of the valve presser 1058 in the above direction, the valve member is shifted from a state in which the valve is fully opened shown in FIG. 32C to a state in which the valve is closed shown in FIG. 32A via a state of predetermined area shown in FIG. 32B.

Hereby, as fuel is not obtained from the fuel pump 3, the fuel pressure in the diaphragm lower chamber 1068 is reduced again when fuel is discharged into the fuel rail 10. Then, as the sum of the fuel pressure in the diaphragm lower chamber 1068 and the pressure by the compression coil spring 1053 is reduced by the sum of the inner pressure in the diaphragm upper chamber 1069 and the pressure by the compression coil spring 1054, the valve presser 1058 is moved in the direction in which the valve is opened as described above. As the valve member 1051 is moved in the direction in which the valve is closed or opened because of the displacement of the valve presser 1058 by repeating the increase and the reduction of the fuel pressure in the diaphragm lower chamber 1068 as described above, a predetermined difference between the inner pressure in the diaphragm upper chamber 1069 and the inner pressure in the diaphragm lower chamber 1068 can be kept. Therefore, a predetermined difference between the diaphragm upper chamber 1069 and the diaphragm lower chamber 1068, for example the difference of pressure of 20 kPa can be precisely controlled.

A method of fixing a current value by controlling the so-called ratio of duty in which the width of a voltage applied pulse can be varied may be adopted in addition to a constant current control system described in this embodiment.

Figure 34:
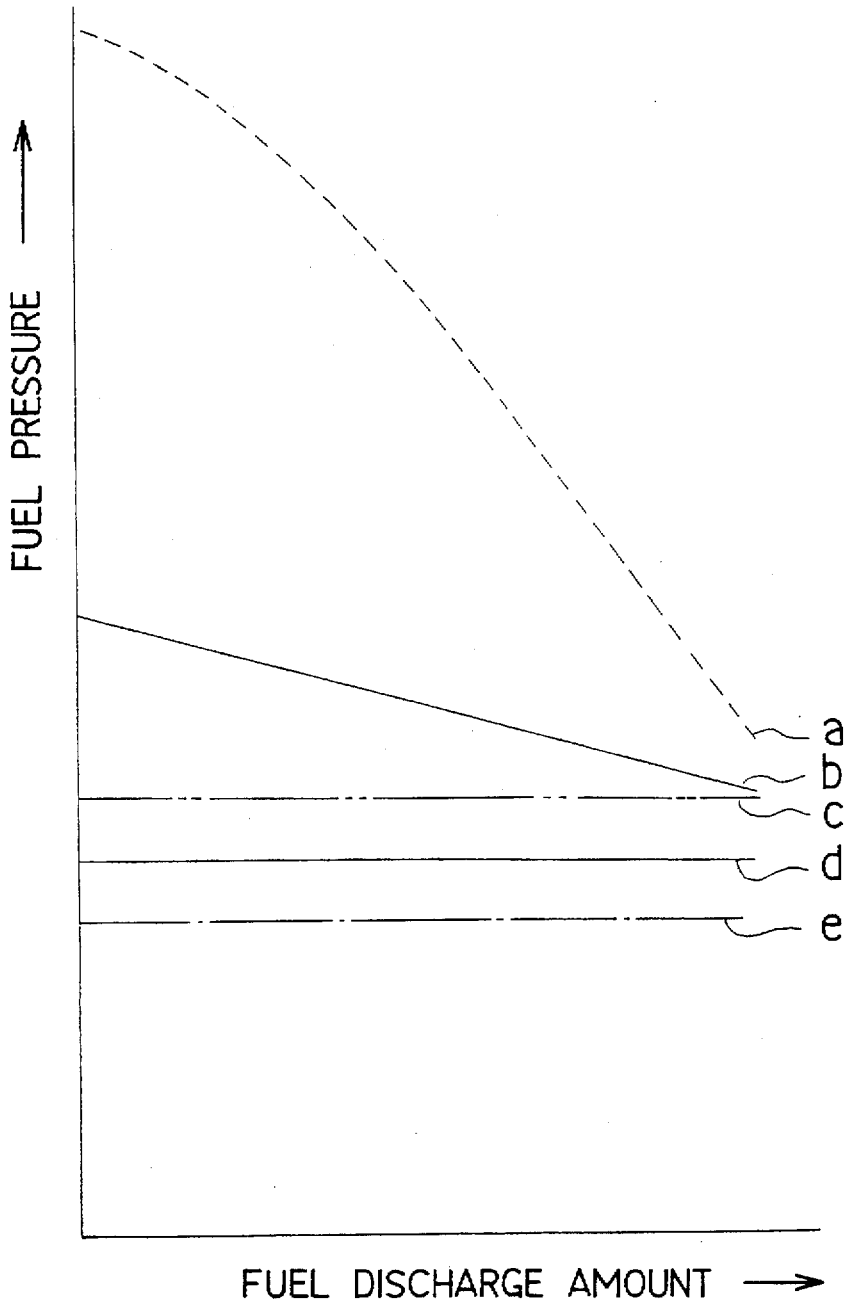
FIG. 34 shows characteristics showing fuel pressure inside a fuel rail corresponding to the amount of fuel discharged from the fuel rail in a fuel supply system for an internal combustion engine equivalent to the fourteenth embodiment.

As described above, the characteristic b shown in FIG. 34 can be obtained by controlling power supplied to the electric motor of the fuel pump 3 by the constant current type control circuit 13 based upon current. The characteristic a shown in FIG. 34 shows the change of fuel pressure corresponding to the amount of discharged fuel if the motor of the fuel pump is controlled by the constant current type control circuit. These characteristics a and b show that the more fuel is discharged from the fuel rail 10, the lower the fuel pressure inside the fuel rail is and the less fuel is discharged, the higher the fuel pressure is. However, as the tilt of the characteristic b is gentler, compared with the characteristics a and b, the characteristic b shows the change of fuel pressure corresponding to the change of the amount of discharged fuel is small. This is because in the case of a fuel pump with an electric motor, the quantity P of the change of fuel pressure corresponding to the quantity Q of the change of a discharged amount in the characteristic b which is controlled so that current is fixed is smaller than that in the characteristic a which is controlled so that voltage is fixed.

As above, as the case that the change of fuel pressure corresponding to the change of a discharged amount is small is close to the characteristic d obtained by controlling pressure by the above-described pressure control valve 5, there is effect that mechanical control by the pressure control valve 5 is facilitated.

As the range of discharge pressure of the fuel pump 3 can be narrowed by obtaining the characteristic b by approximating the characteristic a to the characteristic d and the increase of fuel pressure can be reduced when the amount of fuel discharged from the fuel pump 3 is small, the mechanical strength of the fuel pipe 9 for connecting the fuel pump 3 and the fuel rail 10 can be reduced. Hereby, there is effect that for example the assembling cost of the fuel pipe 9 can be reduced.

Further, as fuel is not required to be excessively pressed, current consumed by the motor 32 of the fuel pump can be reduced. Hereby, there is effect that the efficiency of a fuel pump can be enhanced.

Furthermore, as excessive rotation of the motor 32 of the fuel pump is reduced, the rotating speed of the fuel pump 3 can be reduced. Hereby, there is effect that noise caused by the rotation of the pump motor 32 can be reduced.

The characteristics c and e shown in FIG. 34 show the case that the compression coil spring 1054 which displaces the above-described valve presser 1058 in the direction in which the valve is opened is formed by a shape memory alloy. The pressure by the compression coil spring 1054 formed by a shape memory alloy varies depending upon the temperature of fuel which flows into the diaphragm lower chamber 1068. Then, as the condition of displacement of the valve presser 1058 is varied, the characteristics c and e shown in FIG. 34 are obtained. The characteristic c is obtained when the temperature of fuel is high and the characteristic e is obtained when it is low. As above, if the compression coil spring 1054 is formed by a shape memory alloy, pressure controlled by the pressure control valve is variable according to the temperature of fuel.

As described above, according to this embodiment, the range of discharge pressure from the fuel rail 10 can be narrowed by controlling the motor of the fuel pump 3 by the constant current type control circuit 13 so that current is fixed and further, fuel pressure can be kept fixed predetermined pressure independent of the amount of fuel discharged from the fuel rail 10 by combining the above-described constant current control and the control of the pressure inside the fuel rail 10 by the pressure control valve 1005. Hereby, the rotating speed of the fuel pump can be controlled by simple constitution. Therefore, there is effect that the rotating speed of the fuel pump used for the returnless fuel supply system can be controlled by simple constitution and a returnless fuel supply system without using the conventional control circuit for controlling based upon data of a plurality of I/O outputs can be realized.

Also, the area of the passage can be kept fixed in the range of a predetermined distance h from the valve member 1051 immediately after the valve is opened by providing the spool 1051*a* with the length h in the axial direction to the valve member 1051 according to this embodiment. Hereby, as the quantity lifted by the valve member 1051 can be increased even when fuel flows by small quantity in a low load area of an internal combustion engine, the valve member 1051 and the body of the valve 1052 can be prevented from colliding due to pressure pulsation and the vibration of an internal combustion engine. Therefore, there is effect that as the abrasion of the body of the valve 1052 by the valve member 1051 can be prevented, the operation of the valve can be stabilized.

Further, according to this embodiment, as a spherical portion 1058*a* is formed approximately in the center of the valve presser 1058 for moving the valve member 1051 in the direction in which the valve is opened, a part of the spherical portion 1058*a* of the valve presser 1058 is contact with the upper end face of the valve member 1051 even if the valve presser 1058 is displaced with, for example the diaphragm 1060 tilted. Hereby, as the valve presser 1058 can be prevented from being contact from the direction tilted to the axis of the valve member 1051, the side wall of the valve member 1051 and the outer guide 1052*a* equivalent to the inner wall of the valve 1052 can be prevented from being worn. Therefore, there is effect that the valve member 1051 can be prevented from being rattled due to the abrasion of the valve member 1051 or the body of the valve 1052.

Furthermore, the pressure by the compression coil spring 1054 is variable according to the temperature of fuel by forming the compression coil spring 1054 for displacing the valve presser 1058 in the direction in which the valve is closed by a shape memory alloy according to this embodiment. Hereby, as the condition of the displacement of the valve presser 1058 varies depending upon the temperature of fuel which flows into the diaphragm lower chamber 1068, there is effect that the pressure control valve 5 which can control pressure according to the temperature of fuel can be realized.

However, the present invention is not limited to the above-described embodiments and it is natural that the present invention may be embodied in a variety of embodiments in the range which does not deviate from the present invention.

For example, a method of judging based upon the aperture of a throttle may be adopted in place of the above-described idle switch.

Also, the above embodiment can be applied to a system in which the pressure of the intake air passage is detected and the fuel pressure is controlled to have a constant pressure difference between the fuel pressure and the intake passage pressure.

What is claimed is:

1. A fuel supply system for an internal combustion engine, said system comprising:

an electronically pulse-width controlled fuel injection valve;

a delivery pipe disposed for supplying fuel to said fuel injection valve;

a fuel pump driven by a dc electric motor disposed for feeding fuel to said delivery pipe at a controlled pressure;

a motor driving circuit arranged to supply driving current to said electric motor;

first means storing data representing a relationship between target fuel pressure and engine operating conditions, which conditions include intake air amounts and engine speeds, for providing a target current value for said dc motor and a target flow rate value for fuel to be injected by said fuel injection valve according to said engine operating conditions;

second means for detecting the driving current supplied to said electric motor;

third means for correcting said driving current towards said target current value; and fourth means for compensating differences between a flow rate of fuel injected by said injection valve and said target flow rate value according to said stored relationship thereby driving said fuel pump to feed fuel at said controlled pressure.

2. A fuel supply system for an internal combustion engine as in claim 1, wherein:

said target flow rate value is determined based upon a pulse width signal driving said fuel injection valve and upon engine speed.

3. A fuel supply system for an internal combustion engine as in claim 1, wherein:

said target flow rate value is determined based upon said intake air amount.

4. A fuel supply system for an internal combustion engine as in claim 1, wherein:

said fuel pump has a bypass passage for discharge of said fuel.

5. A fuel supply system for an internal combustion engine as in claim 4, wherein:

said bypass passage includes a valve having an adjustable opening.

6. A fuel supply system for an internal combustion engine as in claim 4, wherein:

said bypass passage has a flow rate regulating member which is detachable.

7. A fuel supply system for an internal combustion engine as in claim 1 further comprising:

a pressure control valve for correcting said fuel supply pressure towards a constant value, said valve being disposed between said fuel injection valve and said fuel pump.

8. A fuel supply system for an internal combustion engine according to claim 7, wherein said pressure control valve comprises:

a first pressure chamber set to a predetermined pressure;

a second pressure chamber whose fuel pressure is equal to that inside said delivery pipe;

a diaphragm which is displaced according to the change of pressure in said first pressure chamber and said second pressure chamber for partitioning said first pressure chamber and said second pressure chamber which communicate with each other;

a valve presser which is located on the second pressure chamber side of said diaphragm and pressed thereto by a pressing means; and a valve with which said valve presser is in contact for blocking or allowing communication of said second pressure chamber and the discharge side of said fuel pump according to the displacement of said valve pressed;

wherein said second pressure chamber and the discharge side of said fuel pump communicate by a predetermined passage in a predetermined distance after said valve is shifted from a closed state to an open state.

9. A fuel supply system for an internal combustion engine according to claim 7, wherein:

said pressure control valve is provided with:

a first pressure chamber set to predetermined pressure;

a second pressure chamber the fuel pressure of which is equal to that inside said fuel rail;

a diaphragm which is displaced according to the change of pressure in said first pressure chamber or said second pressure chamber for partitioning said first pressure chamber and said second pressure chamber which communicate with each other;

a valve presser which is located on the side of said second pressure chamber of said diaphragm, provided with a convex spherical portion which is protruded in the direction of said second pressure chamber and pressed to the side of said second pressure chamber by a pressing means; and a valve means with which said convex spherical portion is contact for blocking or allowing communication of said second pressure chamber and the discharge side of said fuel pump according to the displacement of said valve presser.

10. A fuel supply system for an internal combustion engine according to claim 7, wherein:

said pressure control valve is provided with:

a first pressure chamber set to predetermined pressure;

a second pressure chamber the fuel pressure of which is equal to that inside said fuel rail;

a diaphragm which is displaced according to the change of pressure in said first pressure chamber or said second pressure chamber for partitioning said first pressure chamber and said second pressure chamber which communicate with each other;

a valve presser located on the side of said second pressure chamber of said diaphragm;

a pressing means formed by a shape memory alloy for pressing said valve presser in the direction of said second pressure chamber with pressure according to the temperature of fuel fed into said second pressure chamber; and a valve means with which said valve presser is contact for blocking or allowing communication of said second pressure chamber and the discharge side of said fuel pump according to the displacement of said valve presser.

11. A fuel supply system for an internal combustion engine as in claim 1, wherein:

said fourth means controls said fuel injection valve to adjust the flow rate to said target flow rate value according to said stored relationship.

12. A fuel supply system for an internal combustion engine as in claim 11, wherein:

said first means determines a compensated pulse width signal to control said fuel injection valve according to said stored relationship.

13. A fuel supply system for an internal combustion engine as in claim 12, wherein:

said first means provides said compensated pulse width signal based upon said target flow rate value.

14. A fuel supply system for an internal combustion engine as in claim 12, wherein:

said first means increases the pulse width of said signal as said target flow rate value increases.

15. A fuel supply system for an internal combustion engine as in claim 1, wherein:

said stored relationship includes a relationship between said target flow rate value and said controlled pressure; and said first means provides a compensated pulse width signal based upon said controlled pressure according to said relationship.

16. A fuel supply system for an internal combustion engine as in claim 11, wherein:

said first means changes said target current value as said target flow rate value changes.

17. A fuel supply system for an internal combustion engine as in claim 15, wherein:

said first means increases said target current value as said target flow rate value increases.

18. A fuel supply system for an internal combustion engine as in claim 1, wherein:

said fuel pump has a check valve disposed on a discharge side thereof.

19. A fuel supply system for an internal combustion engine as in claim 18 further comprising:

another check valve having a different opening pressure.

20. A fuel supply system for an internal combustion engine as in claim 1, wherein:

said fuel pump has a check valve and a relief valve disposed on an inflow side thereof so that said valves are opened at respectively corresponding pressures in the opposite directions, and said relief valve is opened at a pressure higher than fuel vapor pressure in said delivery pipe.

21. A fuel supply system for an internal combustion engine as in claim 5, wherein:

said bypass passage has a first fixed opening area and a second variable opening area connected in series with said first fixed opening area.

22. A fuel supply system for an internal combustion engine as in claim 21, wherein:

said second variable opening area includes a conic tapered portion for changing said variable opening area by moving the tapered portion in its axial direction by screwing.

23. A method of controlling a fuel supply system for an internal combustion engine having a fuel delivery pipe, an electronically controlled fuel injection valve and a fuel pump driven by a dc motor for feeding fuel to said fuel delivery pipe at a controlled pressure, said method comprising steps of:

generating a target flow rate value for said fuel pump based on a relationship between said target flow rate value and the target driving current of said dc motor;

correcting the pump driving current of said dc motor toward said target driving current; and electronically controlling said fuel injection valve to compensate for a difference between the flow rate of fuel injected by said injection valve and said target flow rate value.

24. A method of controlling a fuel supply system for an internal combustion engine as in claim 23, wherein said step of controlling said fuel injection valve comprises the steps of:

generating a relationship between target flow rate value and said controlled pressure;

detecting the rotational speed of said fuel pump;

obtaining an actual fuel flow rate value from said detected rotational speed;

controlling actual fuel pressure according to said relationship between said the target fuel flow rate value and said controlled fuel pressure; and controlling said injection valve to adjust its injected fuel flow rate toward said target flow rate value.

* * * * *